US008491797B1

(12) United States Patent
Happel

(10) Patent No.: US 8,491,797 B1
(45) Date of Patent: Jul. 23, 2013

(54) PIVOTING PANEL, PYLON AND INFLOW GAP FOR STORMWATER SCREEN SYSTEM

(76) Inventor: Tom Happel, Cocoa, FL (US)

( * ) Notice: Subject to any disclaimer, the term of this patent is extended or adjusted under 35 U.S.C. 154(b) by 259 days.

(21) Appl. No.: 12/963,125

(22) Filed: Dec. 8, 2010

Related U.S. Application Data

(60) Provisional application No. 61/364,972, filed on Jul. 16, 2010.

(51) Int. Cl.
*E03F 5/14* (2006.01)

(52) U.S. Cl.
CPC ..... *E03F 5/14* (2013.01)
USPC ... 210/747.3; 210/136; 210/162; 210/170.03; 210/420; 210/421

(58) Field of Classification Search
USPC ..... 210/747.3, 767, 136, 162, 170.03, 210/418, 419, 420, 421
See application file for complete search history.

(56) References Cited

U.S. PATENT DOCUMENTS

| | | | |
|---|---|---|---|
| 232,948 | A | 10/1880 | Dernham |
| 587,559 | A | 8/1897 | Riley |
| 664,945 | A | 1/1901 | Guion |
| 809,201 | A | 1/1906 | Lutz |
| 2,182,795 | A | 12/1939 | Day |
| 2,615,526 | A | 10/1952 | Lane |
| 3,282,430 | A | 11/1966 | Kinne |
| 4,738,644 | A | 4/1988 | Happel |
| 5,037,541 | A | 8/1991 | Ruey-Jang |
| 5,069,781 | A | 12/1991 | Wilkes |
| 5,284,580 | A | 2/1994 | Shyh |
| 5,397,464 | A | 3/1995 | Hannon |
| 5,403,474 | A | 4/1995 | Emery |
| 5,405,539 | A | 4/1995 | Schneider |
| 5,480,254 | A | 1/1996 | Autry |
| 5,486,287 | A | 1/1996 | Murphy |
| 5,535,554 | A | 7/1996 | Harris |
| 5,562,819 | A | 10/1996 | Turner |

(Continued)

OTHER PUBLICATIONS

Rising and Non-Rising Stem, Telescoping Valves, Halliday Products, 4 pages, retrieved on Jun. 15, 2009, retrieved from www.hallidayproducts.com/ssg.html.

(Continued)

*Primary Examiner* — Christopher Upton
(74) *Attorney, Agent, or Firm* — Brian S. Steinberger; Law Offices of Brian S. Steinberger, P.A.

(57) ABSTRACT

Devices, apparatus, systems and methods for preventing backflow current problems which often have caused debris and litter to pass out of screen type baskets used in storm water treatment systems. A half size or full size pivoting panel at the input end of a basket screen system placed in a storm water treatment chamber can downwardly divert incoming storm water so as to prevent back flow currents from being formed. The pivoting panel can work well during high flow conditions. A half size or full size pylon located in the input end of the basket screen can split and divert incoming storm water to also prevent back flow currents from also being formed. The pylon can work well during low flow conditions. Also, both the half pivoting panel and the half pylon can both be used at the input end of the screen basket. Still furthermore a gap in the floor before the input end of the screen basket can allow for sediment coming to pass down and collect beneath the screen basket.

28 Claims, 27 Drawing Sheets

U.S. PATENT DOCUMENTS

| | | | | |
|---|---|---|---|---|
| 5,632,889 | A | 5/1997 | Tharp | |
| 5,643,445 | A | 7/1997 | Billias | |
| 5,810,510 | A | 9/1998 | Urriola | |
| 5,820,762 | A | 10/1998 | Bamer | |
| 5,904,842 | A | 5/1999 | Billias | |
| 5,985,157 | A | 11/1999 | Leckner | |
| 6,106,707 | A | 8/2000 | Morris | |
| 6,178,565 | B1 | 1/2001 | Franco | |
| 6,231,758 | B1 | 5/2001 | Morris | |
| 6,270,663 | B1 | 8/2001 | Happel | |
| 6,287,459 | B1 | 9/2001 | Williamson | |
| 6,379,541 | B1 * | 4/2002 | Nicholas | 210/162 |
| 6,428,692 | B2 | 8/2002 | Happel | |
| 6,478,954 | B1 * | 11/2002 | Turner et al. | 210/162 |
| 6,797,162 | B2 | 9/2004 | Happel | |
| 6,869,525 | B1 | 3/2005 | Happel | |
| 6,955,756 | B2 * | 10/2005 | Fallon | 210/170.03 |
| 6,979,148 | B2 | 12/2005 | Happel | |
| 7,138,048 | B1 * | 11/2006 | O'Connor et al. | 210/162 |
| 7,153,417 | B2 | 12/2006 | Happel | |
| 7,214,311 | B2 * | 5/2007 | Aberle et al. | 210/136 |
| 7,270,747 | B2 | 9/2007 | Happel | |
| 7,282,142 | B2 * | 10/2007 | Kraft | 210/170.03 |
| 7,294,256 | B2 | 11/2007 | Happel | |
| 7,300,590 | B2 * | 11/2007 | Weir et al. | 210/747.3 |
| 2006/0207922 | A1 | 9/2006 | Dussich | |
| 2009/0134081 | A1 | 5/2009 | Happel | |
| 2009/0166279 | A1 | 7/2009 | Happel | |

OTHER PUBLICATIONS

Aluminum Slide and Weir Glass, Water and Waste Water Valves and Gates, 10 pages, retrieved on Jun. 15, 2009, retrieved from http://ncvg.net/products/alimSlideWeir.html.

* cited by examiner

PIVOTING PANEL, PYLON AND INFLOW GAP FOR STORMWATER SCREEN SYSTEM

This invention claims the benefit of priority to U.S. Provisional Application Ser. No. 61/364,972 filed Jul. 16, 2010.

FIELD OF INVENTION

This invention relates to storm water treatment systems, and in particular to devices, apparatus, systems and methods for preventing backflow current problems that causes debris to overflow a storm water treatment system by utilizing a pivoting panel and/or pylon, along with an optional inflow sediment collection gap.

BACKGROUND AND PRIOR ART

Baskets and screen type systems are sometimes placed in storm water vaults in order to capture floating debris such as leaves and litter, and the like. However these screen systems can sometimes become obstructed by debris and not allow for much water to pass therethrough. When the flows are high and these screen systems can become obstructed, previously captured floatables can escape. For example, a backflow current problem can occur which can cause floating debris to be forced out of a screen system and into the vault and beyond. The backflow current problem can occur when the water flowing current within a screen system starts to flow in the opposite direction to the current flow entering into the screen system. The backflow current problem can cause a screen system to empty out of the screen system any previously captured floating debris and litter. As such, the backflow current problem can result in preventing any further collection of floating debris and litter.

FIG. 1 is a top perspective view of prior art baffle box with storm water and floatables 40 flowing through the screen system 10. FIG. 2 is another top perspective view of the prior art baffle box 20 of FIG. 1 with a backed up screen system 10. Referring to FIGS. 1-2, a screen system 10 includes a baffle box 20 that is intended to remove floatables from the incoming storm water 100 that has floatables 30, such as debris, and litter, mixed in with storm water having debris 40. The storm water with debris 40 passes through inflow pipe 50, where the storm water 60 carry's floatables into the screen system 10, where the floatables 70 filtered by the screen system 10 are accumulated for later removal. The filtered storm water 80 flows out from the outflow pipe 90 of the system 10. Storm water flow 100 into the screen system 10 is diminished by the backup of floatables 30 into the system 10.

Referring to FIGS. 1-2, storm water flow into screen system diminished by backup 100 of floatables in the system 10. The incoming storm water 40 encounters the backup of floatables 100 where turbulence 130 in the screen system 10 agitates previously captured floatables 70 which can flow up and backwards 110 toward the front of the screen system 10. The backflow 120 from the screen system 10 then flows around the sides of the system 10 towards the outflow pipe 90 carrying previously captured floatables 160 out of the baffle box 20. Storm water outflow 150 from the baffle box's 20 then carry's previously captured floatables out of the system 10. The screen system 10 becomes compromised 140 by the backup 100/250 of floatables in the system 10.

Referring to FIGS. 1-2, most of the storm water will not flow through the screen system 10. Turbulence caused by storm water flowing into the backed up screen system 10 agitates the previously collected floatables 160 causing them to escape from the screen system 10 and flow out of the box 20.

Thus, the need exists for solutions to the above problems with the prior art.

SUMMARY OF THE INVENTION

A primary objective of the present invention is to provide devices, apparatus, systems and methods for improving the removal efficiency of screen systems in storm water vaults, and the like, by preventing the formation of a backflow current problem within the screen system.

A secondary objective of the present invention is to provide devices, apparatus, systems and methods for improving storm water screen systems to accumulate floating debris, litter and the like, without losing previously captured debris.

A third objective of the present invention is to provide devices, apparatus, systems and methods for improving storm water screen systems by using half pivot panels.

A fourth objective of the present invention is to provide devices, apparatus, systems and methods for improving storm water screen systems by using full pivot panels.

A fifth objective of the present invention is to provide devices, apparatus, systems and methods for improving storm water screen systems by using half pylons.

A sixth objective of the present invention is to provide devices, apparatus, systems and methods for improving storm water screen systems by using full pylons.

A seventh objective of the present invention is to provide devices, apparatus, systems and methods for improving storm water screen systems by using a combination of half pylons and half pivot panels.

A version of the improved screen system for preventing backflow currents during storm water treatments, can include a screen housing for being placed in a storm water treatment environment, the housing having an input end and an output end, and a backflow current preventer at the input end of the screen housing, wherein the backflow current preventer stops debris for passing out of the screen system when incoming storm water is flowing through the screen system.

The backflow preventer can be a pivoting panel at the input end of the screen housing for diverting the incoming storm water downward through the screen system. The pivoting panel can be sloped at an angle to the incoming storm water flowing through the screen system. Sloping the panel can enhance floatables to be directed downward and moving into the body of the screen system. The panel can be solid. The panel can be perforated. The panel can be rigid. Alternatively, the panel can be flexible.

The pivoting panel can be substantially vertically oriented substantially perpendicular to the incoming storm water flowing through the screen system. A hinge can attach a top portion of the panel to the screen system.

A gap or opening can be located adjacent to the inflow on the bottom of the screen system for allowing sediment from incoming storm water to drop beneath the screen system.

The pivoting panel can be a half panel that is pivotally attached to a ceiling of the screen system and having a bottom end substantially half way between a floor and the ceiling of the screen system.

The pivoting panel can be a full size panel that is pivotally attached to a ceiling of the screen system and having a bottom end substantially adjacent to a floor of the screen system.

The backflow current preventer can be a pylon at the input end of the screen housing for diverting the incoming storm water to horizontally split to left and right sides inside of the screen system.

The pylon can have a flat face on a side facing the incoming storm water.

The pylon can have a rounded face on a side facing the incoming storm water.

The pylon can have a triangular shaped face on a side facing the incoming water.

A gap or opening can be located adjacent to the inflow on the bottom of the screen system for allowing sediment from incoming storm water to drop beneath the screen system.

The pylon can be a half size pylon having a bottom end adjacent to a floor of the screen system. The pylon can be a full size pylon that runs between a floor and ceiling of the screen system.

The backflow preventer can include both a pivoting panel at the input end of the screen housing for diverting the incoming storm water downward through the screen system, and a pylon at the input end of the screen housing for diverting the incoming storm water to horizontally split to left and right sides inside of the screen system.

A gap or opening can be located adjacent to the inflow on the bottom of the screen system for allowing sediment from incoming storm water to drop beneath the screen system.

Another version of the storm water screen system with pivotable gate for preventing backflow currents during storm water treatments can include a screen housing for being placed in a storm water treatment environment, the housing having an input end and an output end, and a pivoting panel at the input end of the screen housing for downwardly diverting the incoming storm water downward through the screen system to prevent back flow current which stops debris from passing out of the screen system when incoming storm water is flowing through the screen system.

A hinge can attach a top portion of the panel to the screen system.

A gap can be located in front of the screen system for allowing sediment from incoming storm water to drop beneath the screen system.

Another version of the storm water screen system with pylon diverter for preventing backflow currents during storm water treatments, can include a screen housing for being placed in a storm water treatment environment, the housing having an input end and an output end, and a pylon at the input end of the screen housing for splitting the incoming storm water through the screen system to prevent backflow current which stops debris from passing out of the screen system when the incoming storm water is flowing through the screen system.

The pylon diverter can have a flat face on a side facing the incoming storm water.

The pylon diverter can be a nonflat flat face facing the incoming storm water.

A gap can be located in front of the screen system for allowing sediment from incoming storm water to drop beneath the screen system.

A method for preventing backflow currents in storm water treatment systems, can include the steps of positioning a screen housing in a storm water treatment environment, the housing having an input end and an output end, flowing incoming storm water with debris into the input end of the screen housing, preventing backflow current from occurring in the screen housing, and stopping debris from passing out of the output end of the screen system when the incoming storm water is flowing through the screen system.

The preventing step can include the step of downwardly diverting the incoming storm water entering into the input end of the screen housing. The downwardly diverting step can include the step of providing a pivotable panel for downwardly diverting the incoming storm water entering into the input end of the screen housing.

The method can further include the step of collecting sediment from the incoming storm water through a gap or opening adjacent to the inflow on the bottom of the input end of the screen housing.

The preventing step can include the step of splitting the incoming storm water entering into the input end of the screen housing. The splitting step can include the step of providing a pylon for splitting the incoming storm water entering the screen housing.

The method can include the step of collecting sediment from the incoming storm water through a gap in front of the input end of the screen housing.

The preventing step can include the steps of downwardly diverting the incoming storm water entering into the input end of the screen housing, and splitting the incoming storm water entering into the input end of the screen housing.

The preventing step can include the steps of providing a pivotable panel for downwardly diverting the incoming storm water entering into the input end of the screen housing, and providing a pylon for splitting the incoming storm water entering into the input end of the screen housing.

The method can include the step of collecting sediment from the incoming storm water through a gap in front of the input end of the screen housing.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
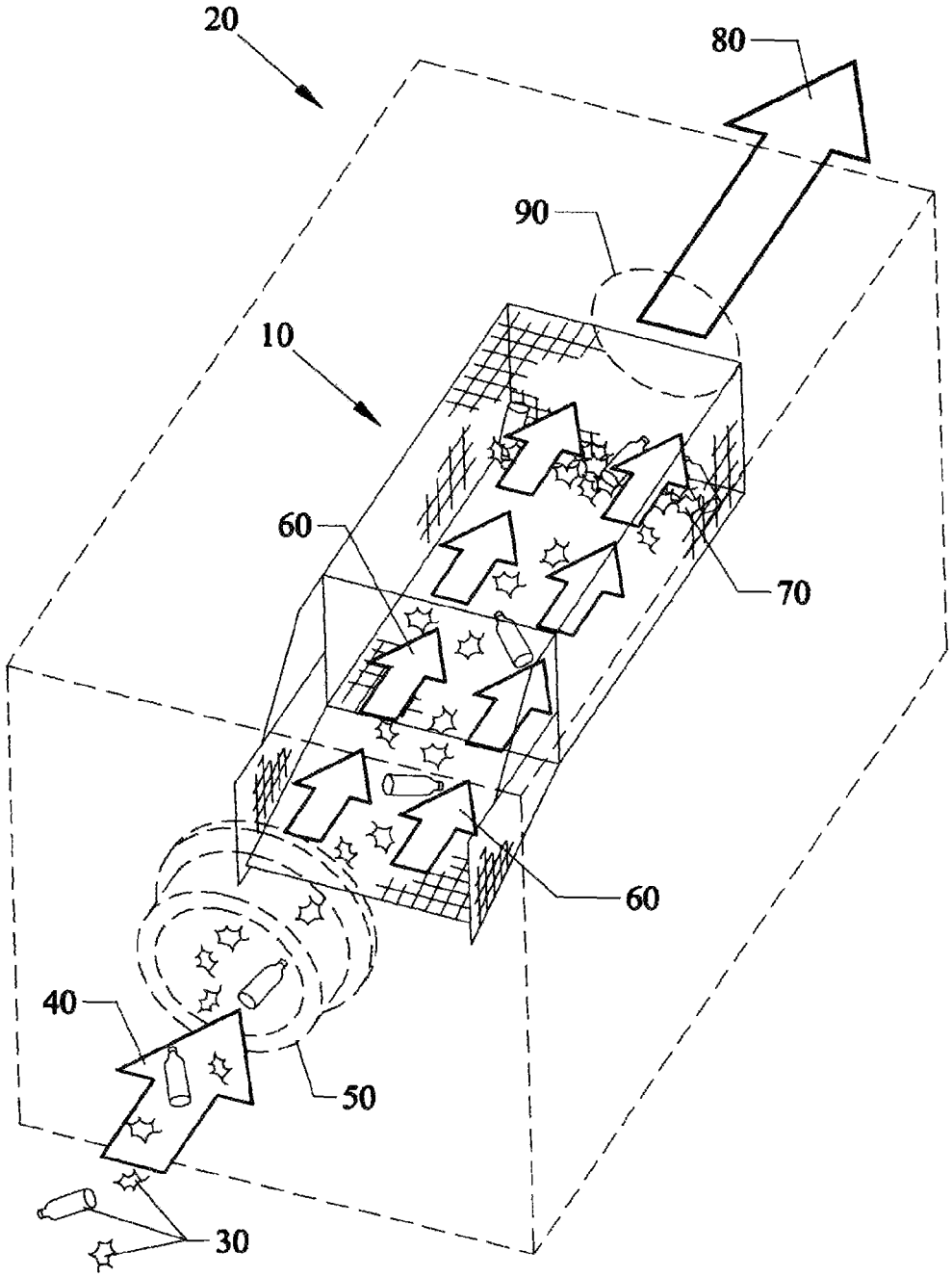
Fig. 1 (Prior Art)
FIG. 1 is a top perspective view of prior art baffle box with storm water and floatables flowing through the screen system.
Figure 2:
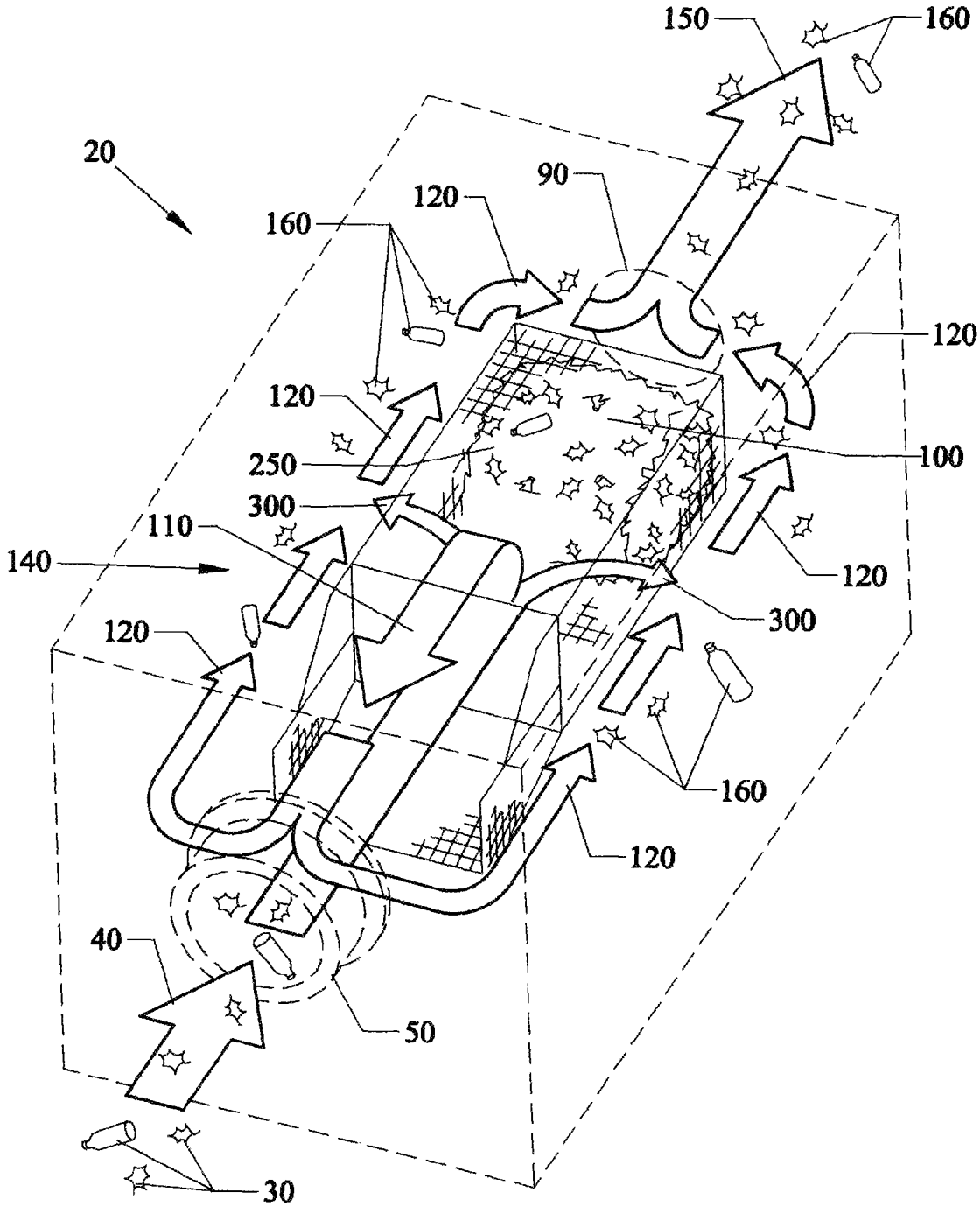
Fig.2 (Prior Art)
FIG. 2 is another top perspective view of the prior art baffle box of FIG. 1 with a backed up screen system.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. A list of the components in the figures will now be described.

10. Prior Art Screen system removes floatables from storm water.
16. Optional inflow gap.
20. Deflector baffle box. Prior art.
30. Floatables washed into baffle box with storm water.
40. Storm water and floatables flow into baffle box.
50. Inflow pipe.
60. Storm water carry's floatables into screen system.
70. Floatables filtered by screen system and accumulated for later removal.
80. Filtered storm water flowing out of baffle box.
90. Outflow pipe.
100. Storm water flow into screen system diminished by backup of floatables in system.
110. Storm water flow into system encounters backup of floatables and flows back out of the screen system entrance. Previously captured floatables, agitated by turbulence in the system, are washed out of the screen system.
120. Backwash from the screen system flows around the system towards the outflow pipe carrying previously captured floatables out of the baffle box.
130. Turbulence in the screen system agitates previously captured floatables.
140. Screen system compromised by backup of floatables blocking free flow through the system.
150. Storm water outflow from baffle box carry's previously captured floatables out of the system.
160. Previously captured floatables.
170. Waterline.
180. Pivoting half panel responds to rate of storm water flow.
190. Pivoting panel hinge.
200. Cross beam in screen system secures the half panel hinge.
210. Bracket attached to side of screen system acts as a down stop for the pivoting half panel.
220. In a screen system that is not backed up with floatables, rising water level and increasing flow rate cause the pivoting half panel to swing up to accommodate flow.
230. Screen system with pivoting half panel or full panel installed to prevent back-flow of previously captured floatables from escaping system.
240. Storm water inflow encounters the half panel locked down by the back pressure inside of the screen system and flows around the screen system out the outflow pipe.
250. Backup of floatables in screen system.
260. Turbulence in backed up screen system applies pressure to the back of the half panel preventing previously collected floatables from escaping the screen system.
270. Some diminished flow through the screen system is possible with a backup of floatables.
280. Storm water flows out of baffle box containing no previously collected floatables.
290. Half pivot panel locked down by turbulence in backed screen system.
300. Storm water flows out of the sides of the screen system bypassing the previously captured floatables.
310. Pivoting full panel.
320. In a screen system that is not backed up with floatables, rising water level and increasing flow rate cause the pivoting full panel to swing up to accommodate flow.
330. Storm water flows around pylon and into screen system.
340. Storm water flows freely past pylon and through screen system.
350. Half height pylon.
360. Part of floor of screen system replaced by solid metal plate to support pylon.
370. Screen system with half or full pylon installed.
380. Diminished flow or storm water flowing into obstructed screen system flows out of the sides of the screen system.
390. Back pressure from the obstructed screen system causes storm water to flow around the screen system.
400. Full height pylon.

Half Pivot Panel Embodiment

Figure 3:
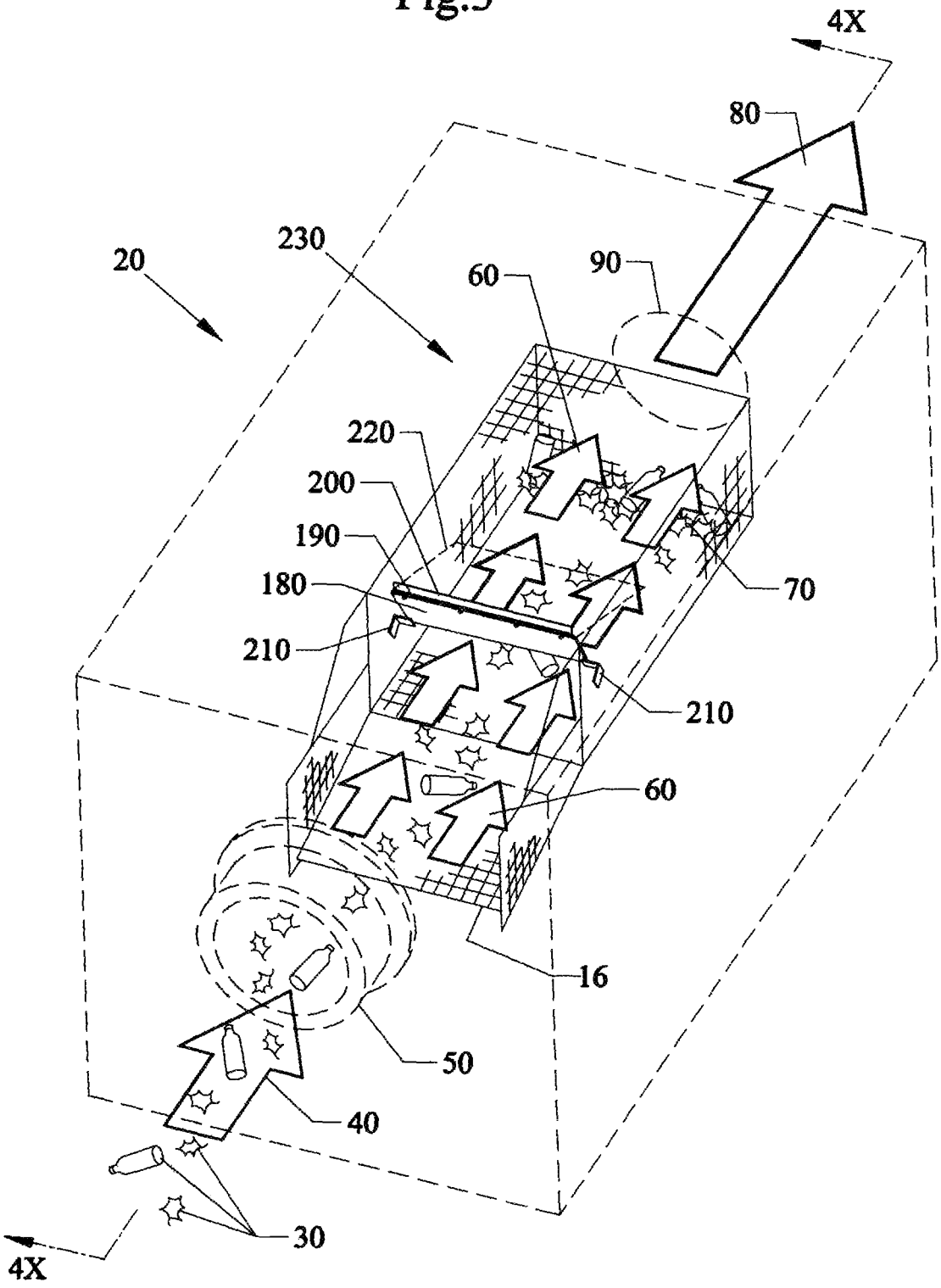
FIG. 3 shows a top perspective view of a baffle box installed with a half pivot panel.
Figure 4:
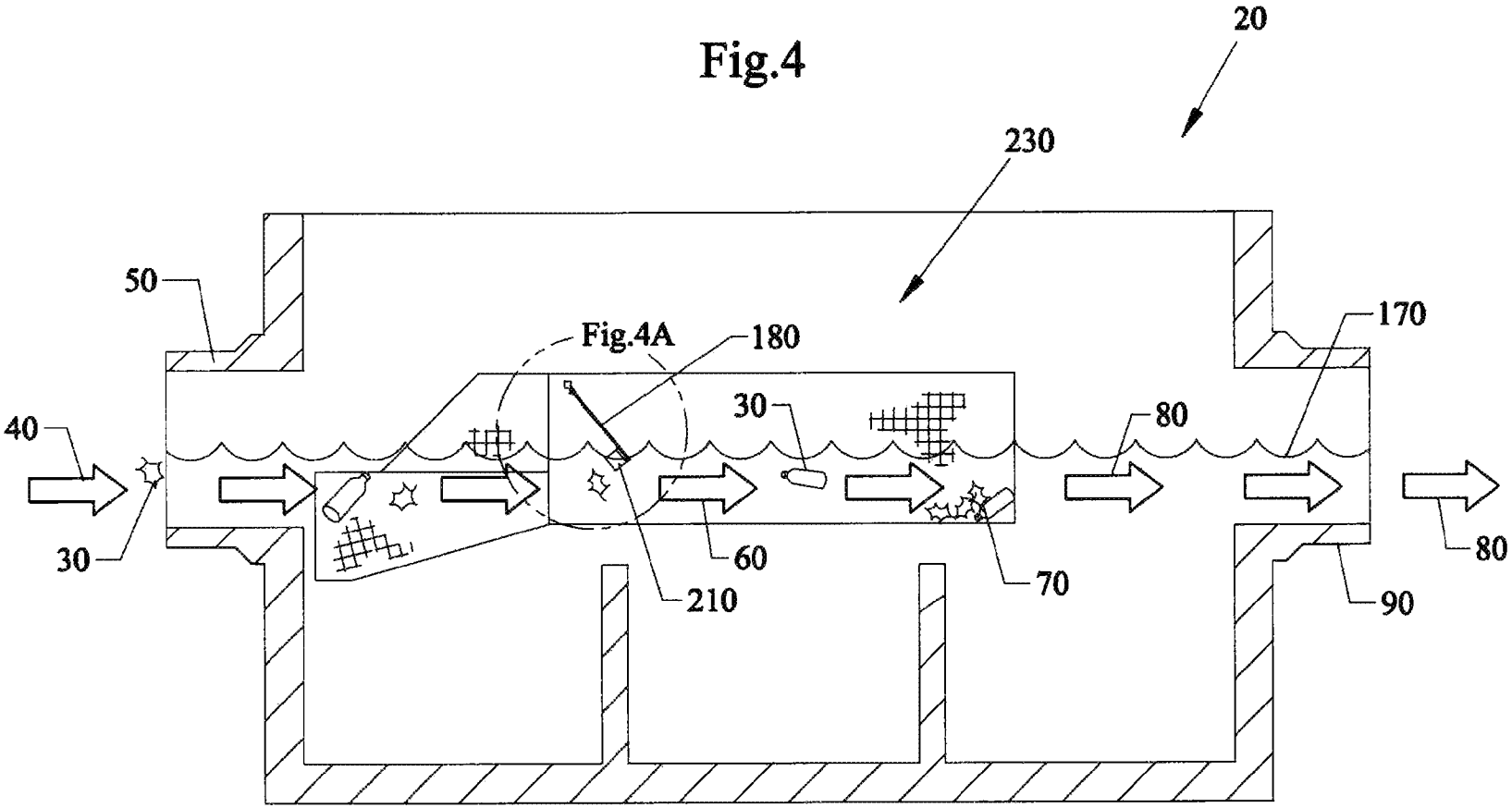
FIG. 4 is a cross-sectional side view of the baffle box with installed half pivot panel along arrows 4X or FIG. 3.
Figure 4A:
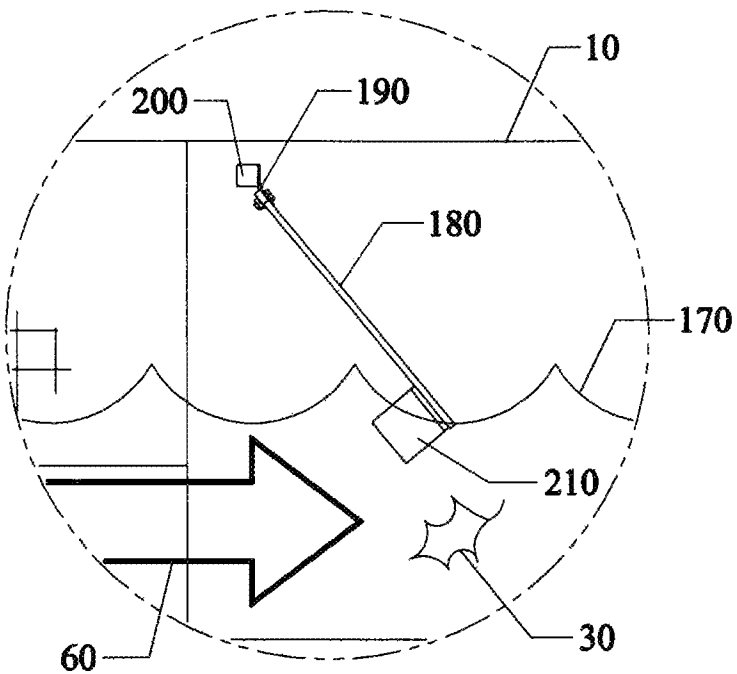
FIG. 4A is an enlarged view of the installed half pivot panel of FIG. 4.

FIG. 3 shows a top perspective view of a baffle box 20 installed with a half pivot panel 180 in a low flow condition. FIG. 4 is a cross-sectional side view of the baffle box with installed half pivot panel 180 along arrows 4X of FIG. 3. FIG. 4A is an enlarged view of the installed half pivot panel 180 of FIG. 4. The embodiment 230 of FIGS. 3-4 uses a screen system with installed pivoting half panel 180 to prevent back-flow of previously captured floatables from escaping the system 10.

The half panel can have a length between approximately ¼ to approximately ¾ of the distance between the ceiling and floor of the screen system. The panel can have a length of approximately ½ to approximately ⅔ of the length between the ceiling and the floor of the screen system, and preferably be half the distance. The panel can be rigid such as being formed from metal, or fiberglass or plastic. The panel can be flexible and be formed from rubber, and similar materials. The panel can be solid. Alternatively, the panel can be porous with holes.

Referring to FIGS. 3, 4 and 4A, a half pivot panel 180 can be attached to a cross beam 200 by a pivoting panel hinge 190. A bracket 210 attached to a side of the screen system 10 acts as a down stop for the pivoting half panel 180. In this low flow condition the panel 180 is down against the down stops 210. The incoming flowing storm water 60 with floatables creates a waterline 170 that allows the half panel to be in the down position. Without incoming storm water, gravity would tend to keep the panel 180 in a generally down position.

The pivoting panel 180 can articulate all the way to a substantially horizontal position so that during high flow events the water flow will not be encumbered by the panel 180. If the screen system 230 does not become obstructed by debris there will be no chance for a hack flow to develop. However, if the screen system 140 becomes significantly obstructed and the flow is high a backflow can develop. If a backflow begins to develop the pivoting panel 180 will be forced down by the force of the backflow current. When the pivoting panel 180 is forced down it will act as a barrier to prevent already captured floating debris from escaping.

Optionally sometimes working in conjunction with the pivoting panel 180 can be an inflow gap 16 between the inflow pipe 50 and the screen system 230. The inflow gap 16 allows for sediment coming with the floating debris in the storm water flowing into the vault to drop into a settling chamber beneath the vault. The inflow gap 16 can be directly under the inflow and before the bottom of the screen system begins. Because sediments are heavier than water they are concentrated along the bottom of the inflowing water 40 and within close proximity to the inflow gap. A relatively high percentage of the sediments will fall through the inflow gap 16 and into the lower sediment collection chamber(s). This changes the ratio of sediment to floatables in the screen system so that less sediment is involved with the collected floating debris. And this enables the floating debris to pass water flow more readily, and in doing so reduces the likelihood that a backflow current will develop. The gap can be any size opening that is larger than the hole size of the screens in the screen enclosure.

Once a storm water causing condition such as a rain event is over the collected floating debris will dry out and to fall off of the vertical walls of the screen system 230.

If the screen system 230 has a screened lid the dried floating debris will fall off of the lid. As the floating debris falls off the screens the openings in the screens become available to handle the water flow from the next storm water type rain event.

Figure 6A:
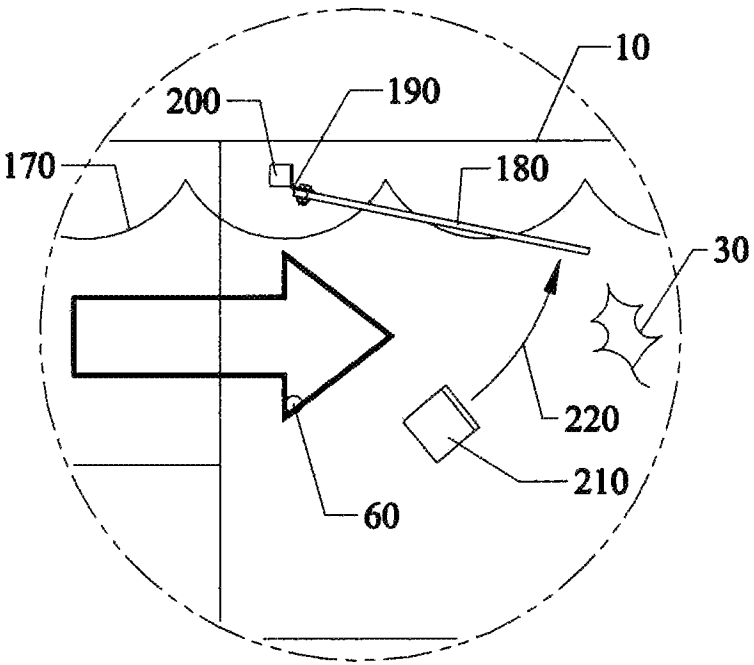
FIG. 6A is an enlarged view of the installed half pivot panel of FIG. 6 in high flow condition.
Figure 5:
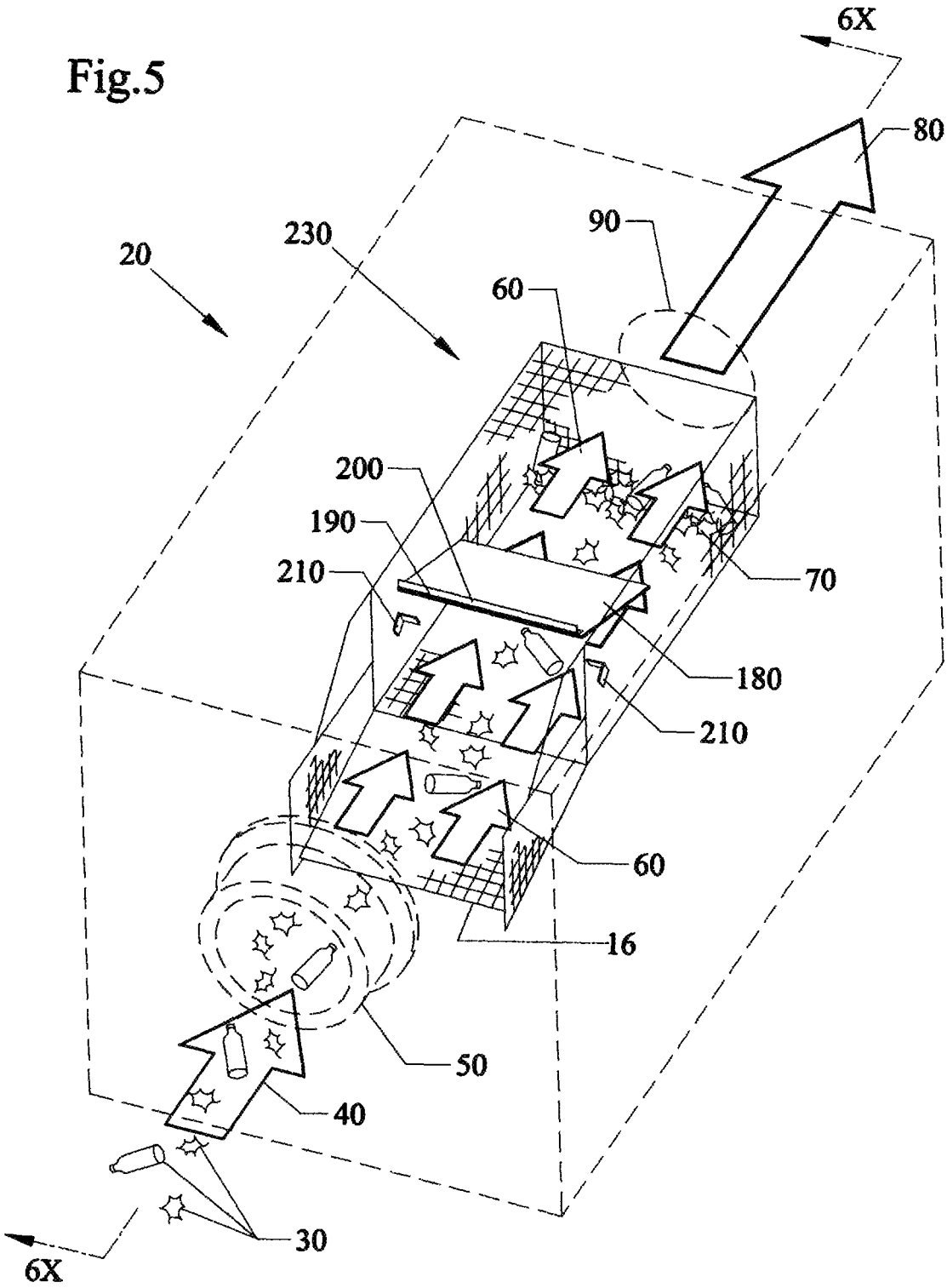
FIG. 5 shows another top perspective view of the baffle box with installed half pivot panel of FIG. 3 in a high flow condition.
Figure 6:
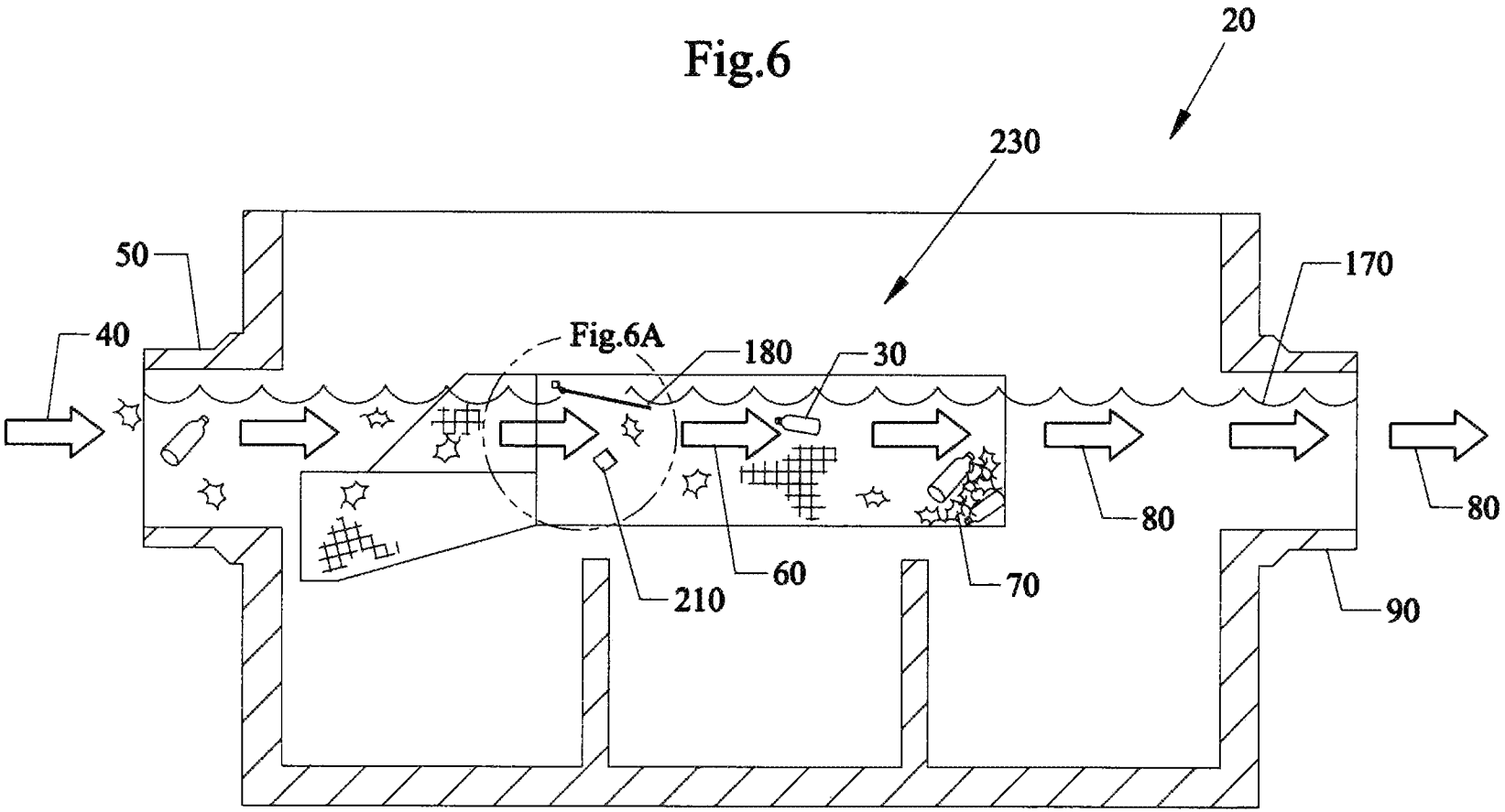
FIG. 6 is a cross-sectional side view of the baffle box with installed half pivot panel of FIG. 5 along arrow 6X in a high flow condition.

FIG. 5 shows another top perspective view of the baffle box 20 with installed half pivot panel 180 of FIG. 3 in a high flow condition. FIG. 6 is a cross-sectional side view of the baffle box 20 with installed half pivot panel 180 of FIG. 5 along arrow 6X in a high flow condition. FIG. 6A is an enlarged view of the installed half pivot panel of FIG. 6 in high flow condition.

In this high-flow condition the half panel 180 has been lifted by the high-flow waterline 170 to permit free passage through the screen system 10. In a screen system 10 that is not backed up with floatables, rising water level and increasing flow rate cause the pivoting half panel 180 to swing up along arrow 220 to accommodate flow.

Figure 7:
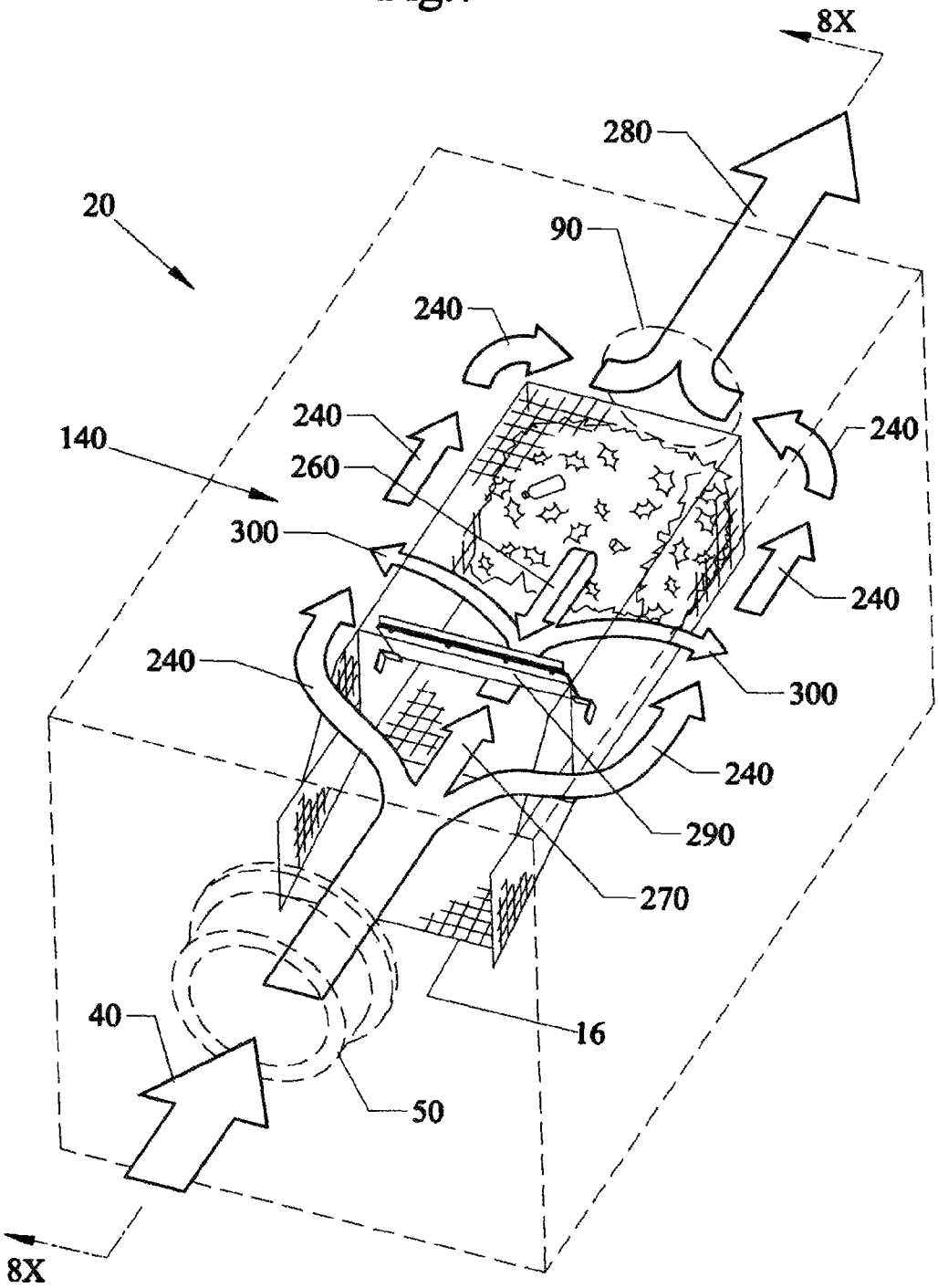
FIG. 7 is a top front perspective view of a baffle box with a backed up screen system and an installed half pivot panel.
Figure 8:
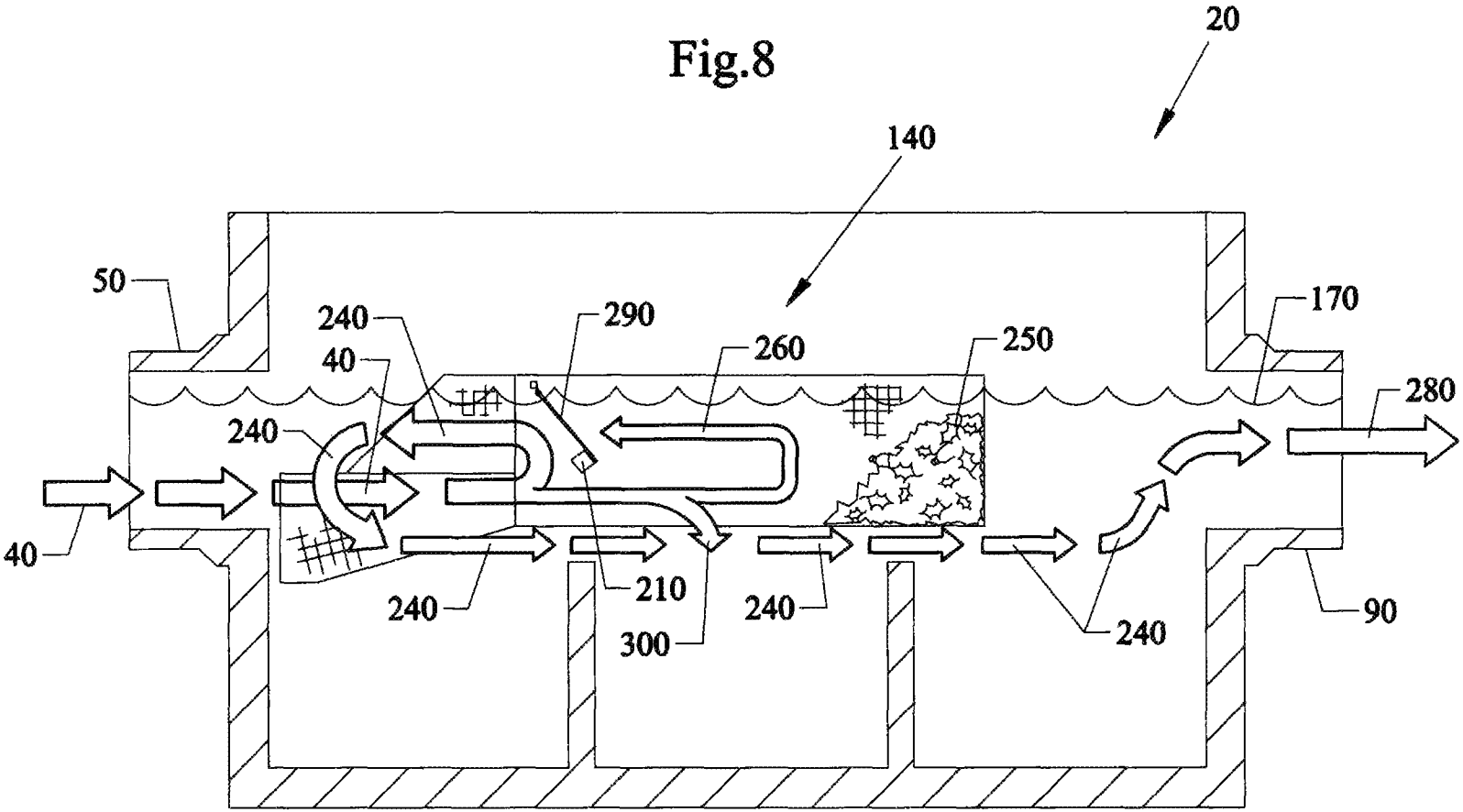
FIG. 8 is a cross-sectional side view of the baffle box with backed up screen system and installed half pivot panel of FIG. 7 along arrow 8X.

FIG. 7 is a top front perspective view of the baffle box 10 with a backed up screen system 10 and an installed half pivot panel 180. FIG. 8 is a cross-sectional side view of the baffle box 20 with backed up screen system 10 and installed half pivot panel 180 of FIG. 7 along arrow 8X.

Referring to FIGS. 7-8, back pressure from turbulence 260 inside the screen system 10 can cause locking of the half pivot panel 180 against the down stops 210 preventing previously collected floatables from escaping. Inflowing storm water is turned away by the half panel 180 and flows around the screen system 10 to the outflow pipe 90. Some of the diminished flow 270 through the screen system 10 flows out the sides of the screen system 10 as shown by arrows 300.

Storm water inflow 40 encounters the half panel 180 locked down by the back pressure inside of the screen system 140 and flows around 240 the screen system 140 out the outflow pipe 90.

Turbulence 260 in the backed up screen system 140 applies pressure to the back of the half panel 180 preventing previously collected floatables from escaping the screen system 140. The half pivot panel 180 is locked down 290 by the turbulence 260 in the backed up screen system 140.

There is some possible diminished flow 270 through the screen system 140 with a backup of floatables 250. At the outflow pipe 90, storm water 280 flows out of the baffle box 20 containing no previously collected floatables. As previously described storm water flows out the sides of the screen system 140 along arrows 300 bypassing the previously captured floatables 70, 250.

Full Pivot Panel

Figure 9:
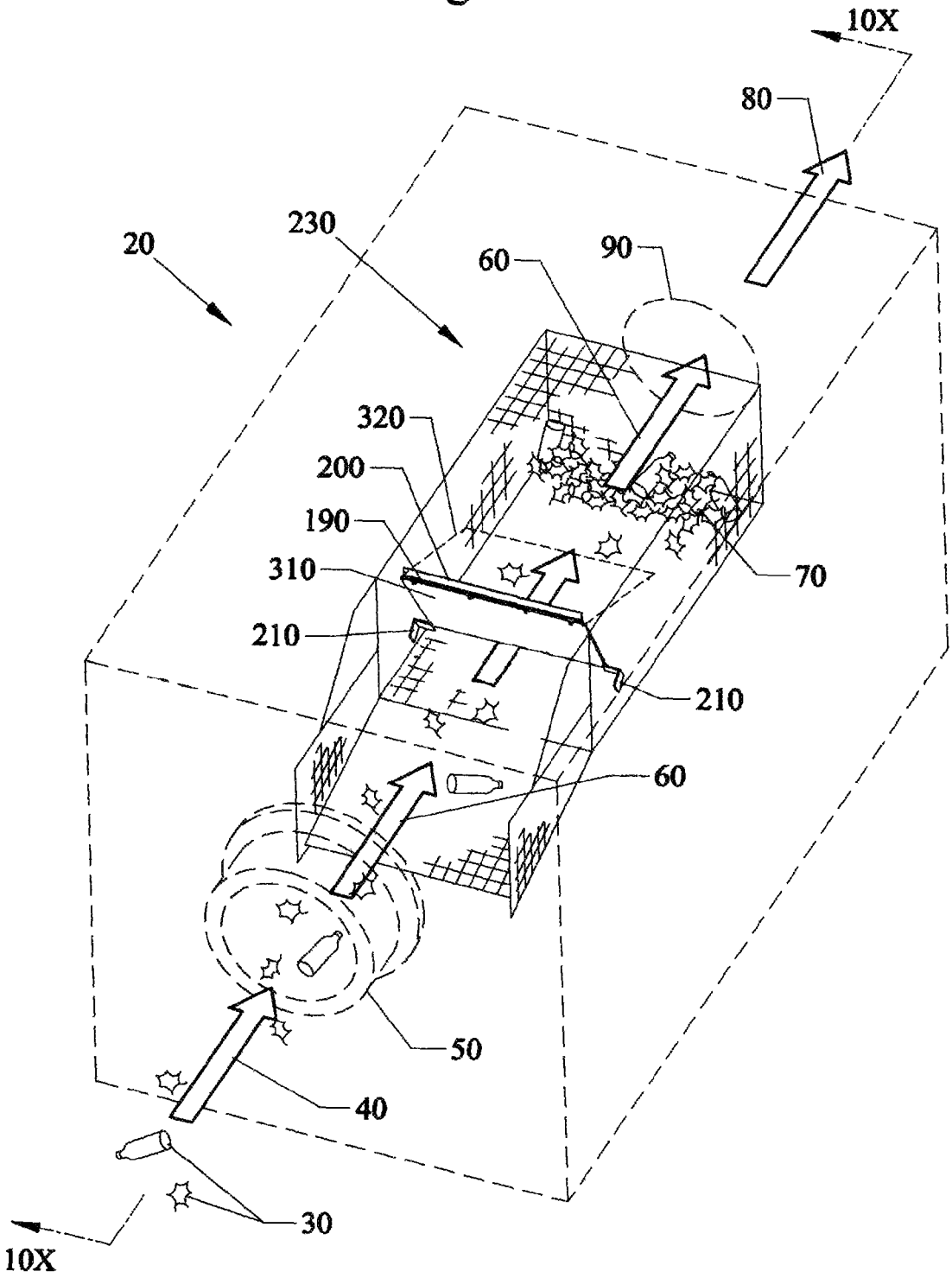
FIG. 9 is a top perspective view of baffle box installed with a full pivot panel.
Figure 10:
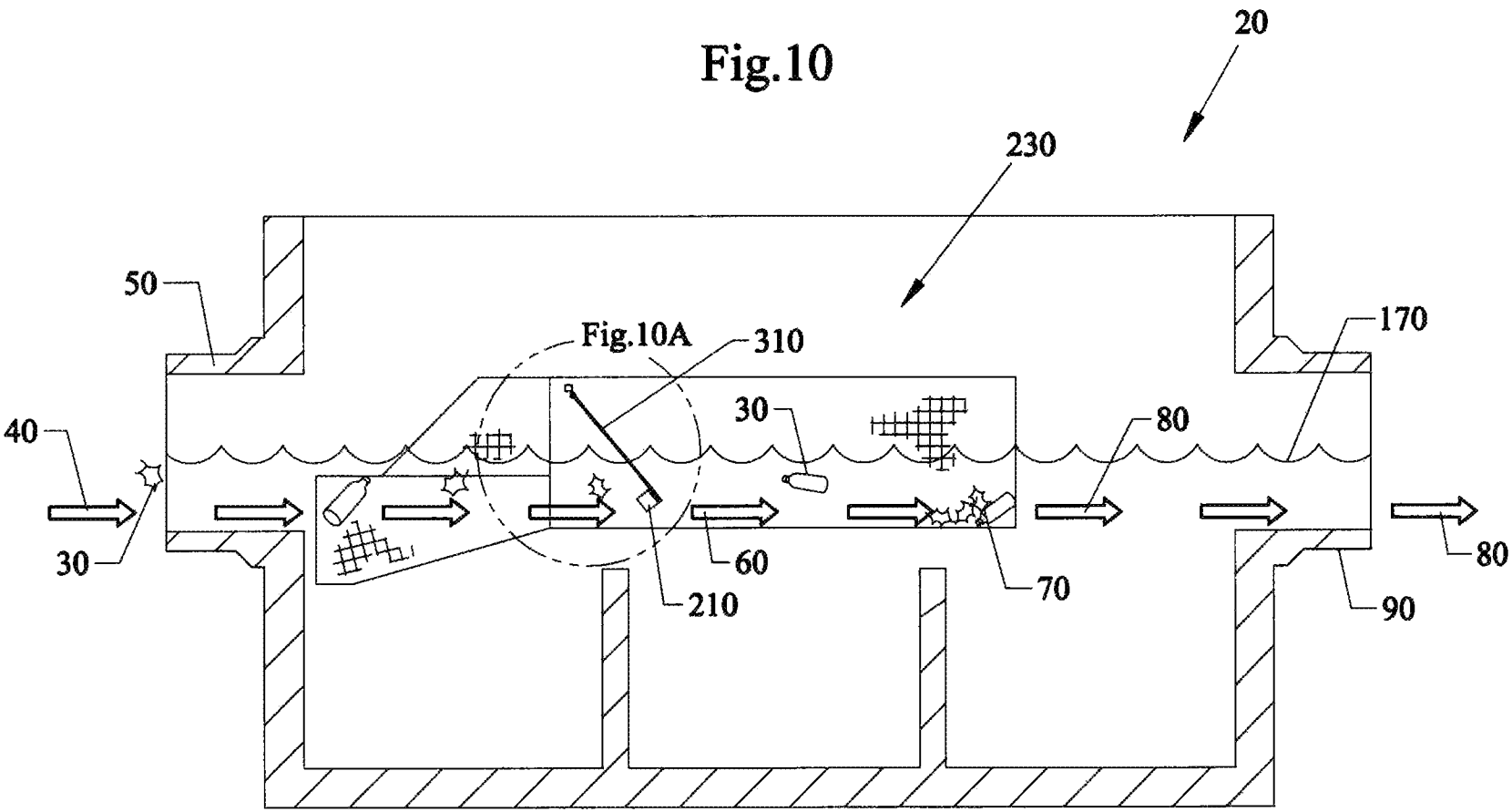
FIG. 10 is a cross-sectional side view of the baffle box with installed full pivot panel of FIG. 9 along arrow 10X.
Figure 10A:
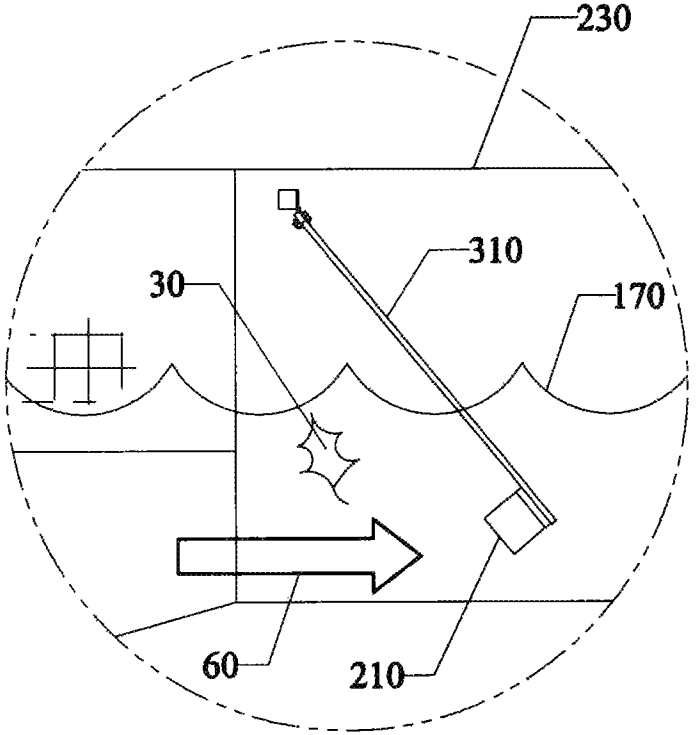
FIG. 10A is an enlarged view of the installed full pivot panel of FIG. 10.

FIG. 9 is a top perspective view of baffle box 20 installed with a full pivot panel 310. FIG. 10 is a cross-sectional side, view of the baffle box 20 with installed full pivot panel 310 of FIG. 9 along arrow 10X. FIG. 10A is an enlarged view of the installed full pivot panel 310 of FIG. 10.

Similar to the half pivot panel 180, the full pivot panel is also attached to a cross beam 200 by a hinge 190. A bracket 210 attached to a side of the screen system 230 acts as a down stop for the pivoting full panel 310. The full panel can have a length at least as long as the height between the ceiling and the floor of the screen system, and be made of similar materials and be solid or porous similar to the half panel, previously described.

Figure 11A:
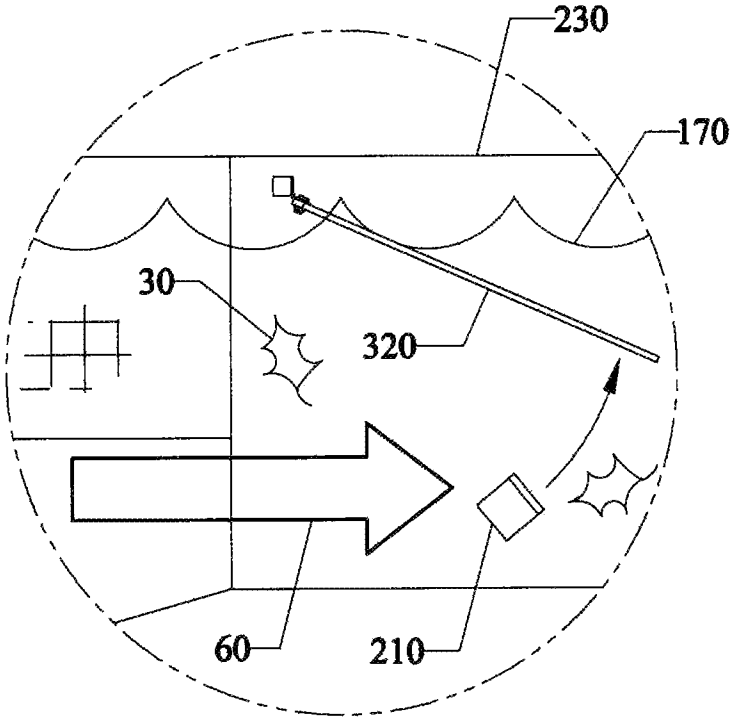
FIG. 11A is an enlarged view of the installed full pivot panel of FIG. 11 in a high flow condition.
Figure 11:
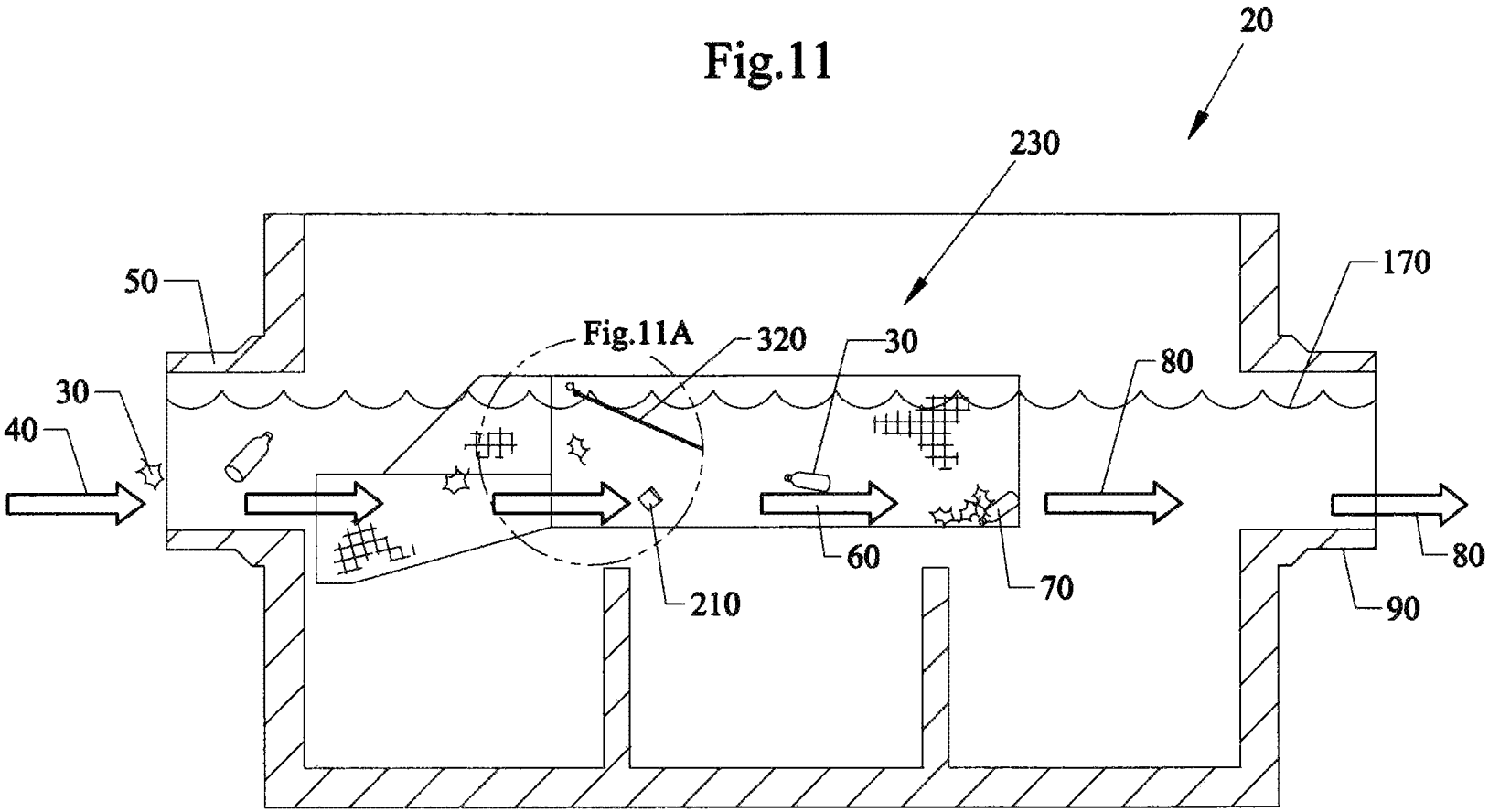
FIG. 11 is a cross-sectional side view of the baffle box with installed full pivot panel of FIG. 9 in a high flow condition.

FIG. 11 is a cross-sectional side view of the baffle box with installed full pivot panel of FIG. 9 in a high flow condition. FIG. 11A is an enlarged view of the installed full pivot panel of FIG. 11 in a high flow condition. In a screen system 230 installed with a full panel 310 and that is not backed up with floatables, rising water level 170 and increasing flow rate can cause the pivoting panel 310 to swing up to position 320 to accommodate flow.

Figure 12:
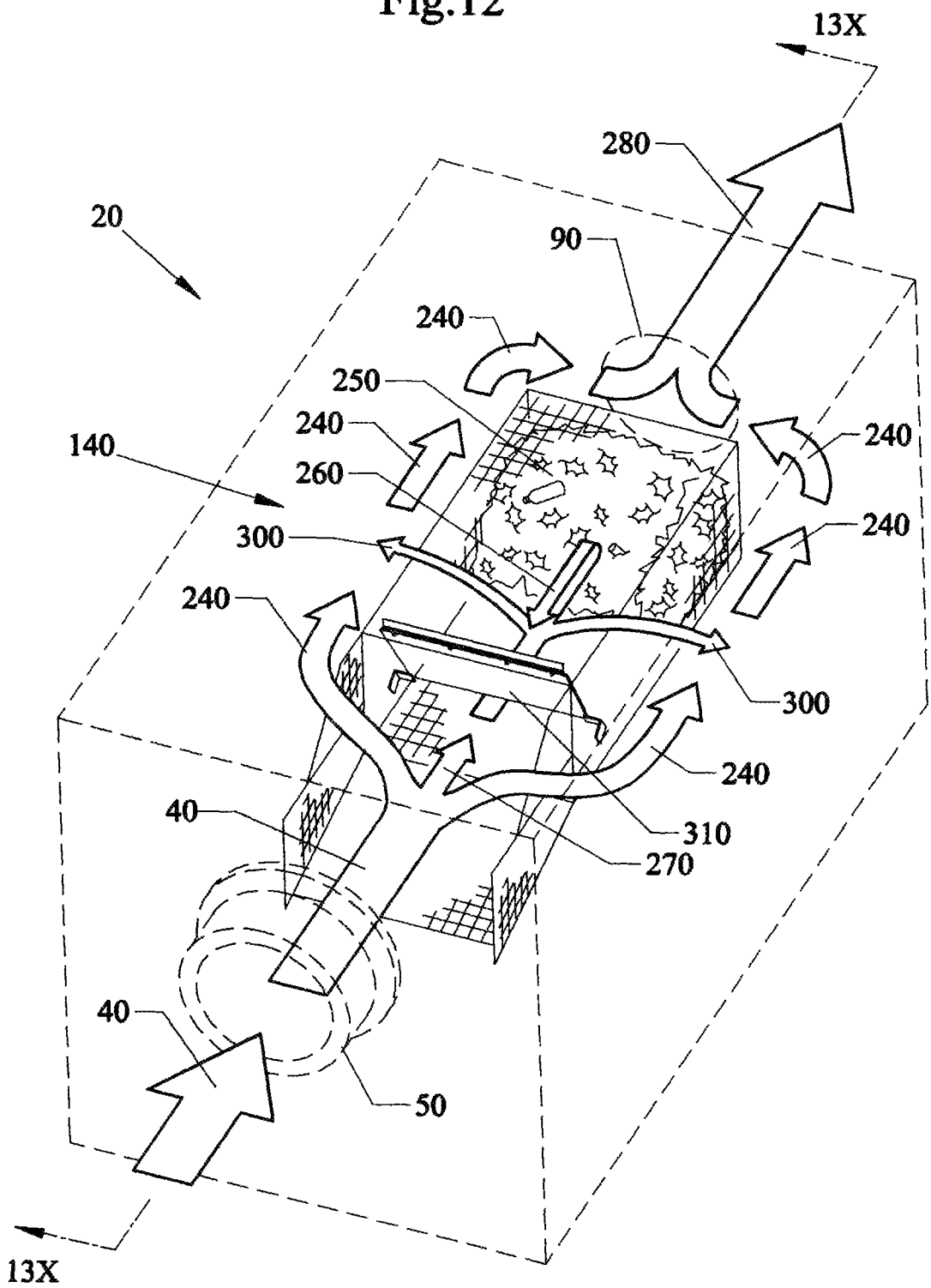
FIG. 12 is a top perspective view of the baffle box with a full pivot panel installed with the screen system being obstructed by floatables.
Figure 13:
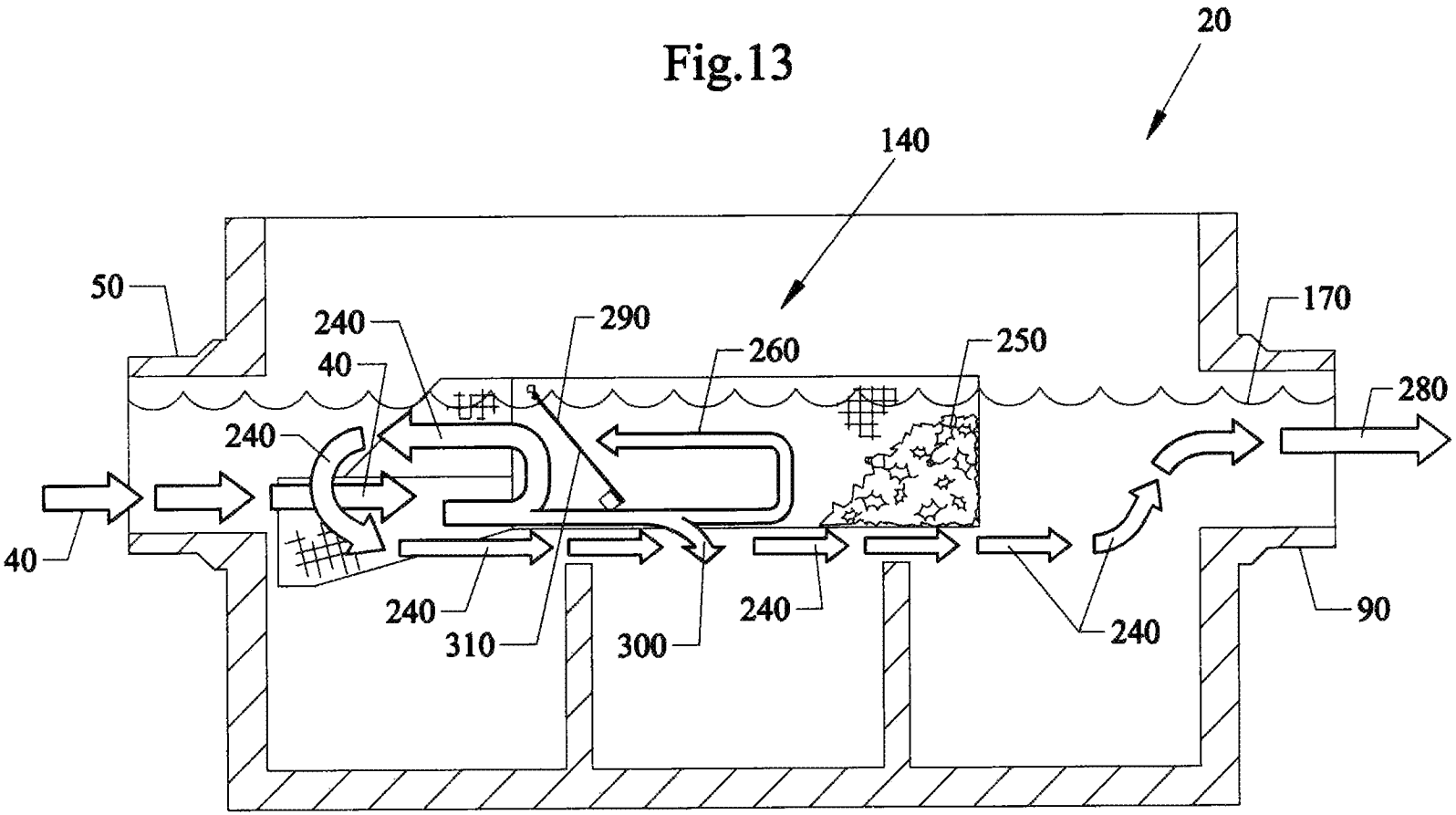
FIG. 13 is a cross-sectional side view of the screen system of FIG. 12 along arrow 13X.

FIG. 12 is a top perspective view of the baffle box 20 with a full pivot panel 310 installed with the screen system 140 being obstructed by floatables. FIG. 13 is a cross-sectional side view of the screen system 140 of FIG. 12 along arrow 13X.

Referring to FIGS. 12-13, back pressure from turbulence 260 inside the screen system is locking the full pivot panel 310 against the down stops 210 preventing previously collected floatables from escaping. Inflowing storm water 40 is turned away by the full panel 310 and flows around 240 the screen system to the outflow pipe 90. Diminished flow 270 under the panel 310 and into the screen system flows out of the sides of the screen system.

The larger and longer panels can be used when there are low amounts of floatables coming into the screen system at any time, and the larger and the longer of the panels can prevent captured floatables from escaping out of the screen system. The shorter panels (half panels) can be used in high flow conditions are occurring much more often.

Half Pylon Embodiment

Figure 14:
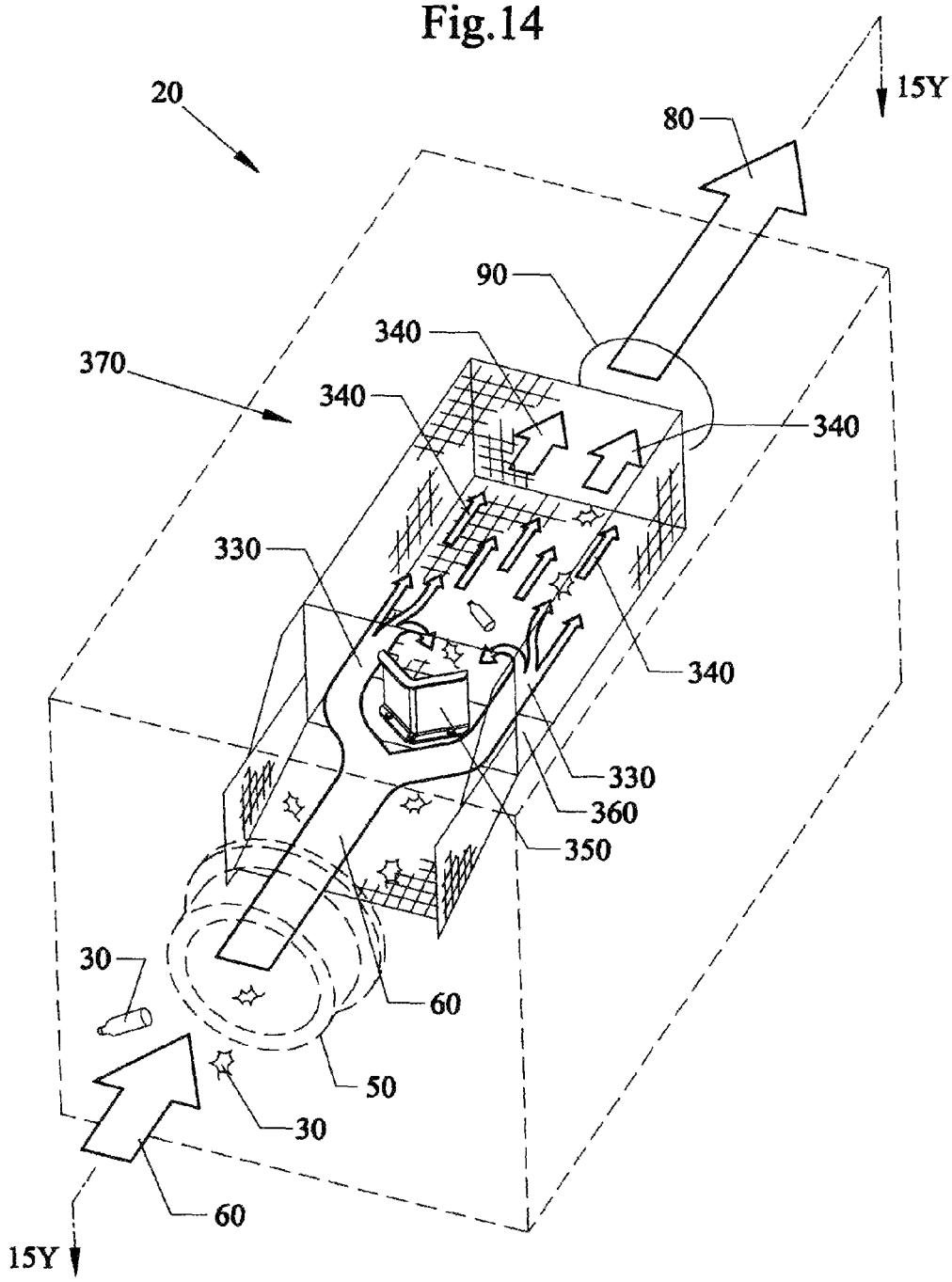
FIG. 14 is a top perspective view of a baffle box with a half pylon installed at the head of the screen system.
Figure 15:
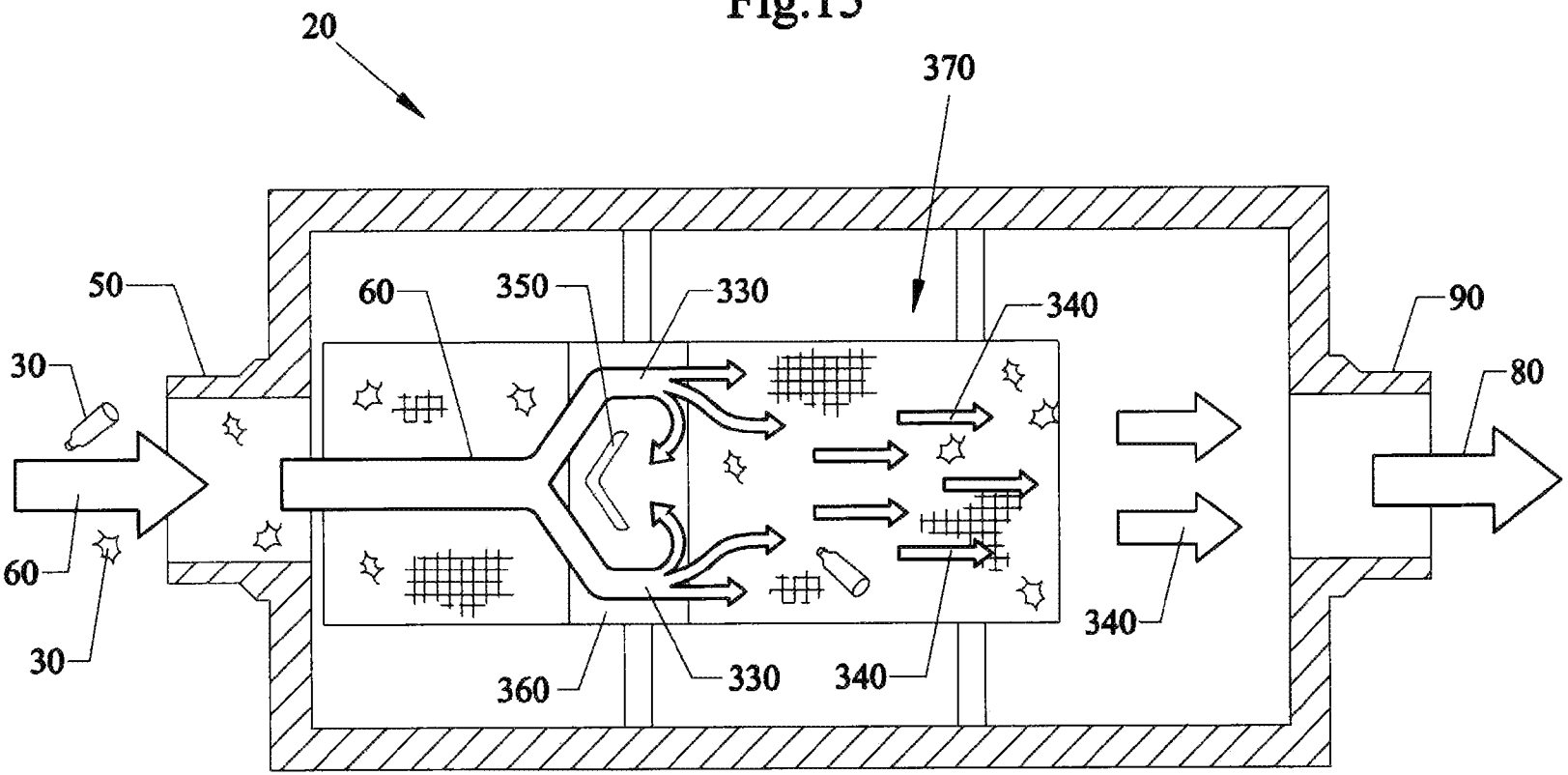
FIG. 15 is a top cross-sectional view of the baffle box with half pylon of FIG. 14 along arrow 15Y.

FIG. 14 is a top perspective view of a baffle box 20 with a half pylon 350 installed at the head of the screen system 370. FIG. 15 is a top cross-sectional view of the baffle box 20 with half pylon 350 of FIG. 14 along arrow 15Y.

Referring to FIGS. 14-15, the half pylon 350 can be mounted on solid plate 360, that replaces part of the floor of the existing screen system, the presence of the pylon 350 discourages back flow out of the screen system 370 which would release previously collected floatables. Water flows freely around 330 the pylon and through 340 the screen system 370.

The pylons can be desirable over pivoting panels when the user does not want any moving parts. The pylons can have a lower amount of maintenance time and costs over the panels by not having any movable parts.

Figure 16:
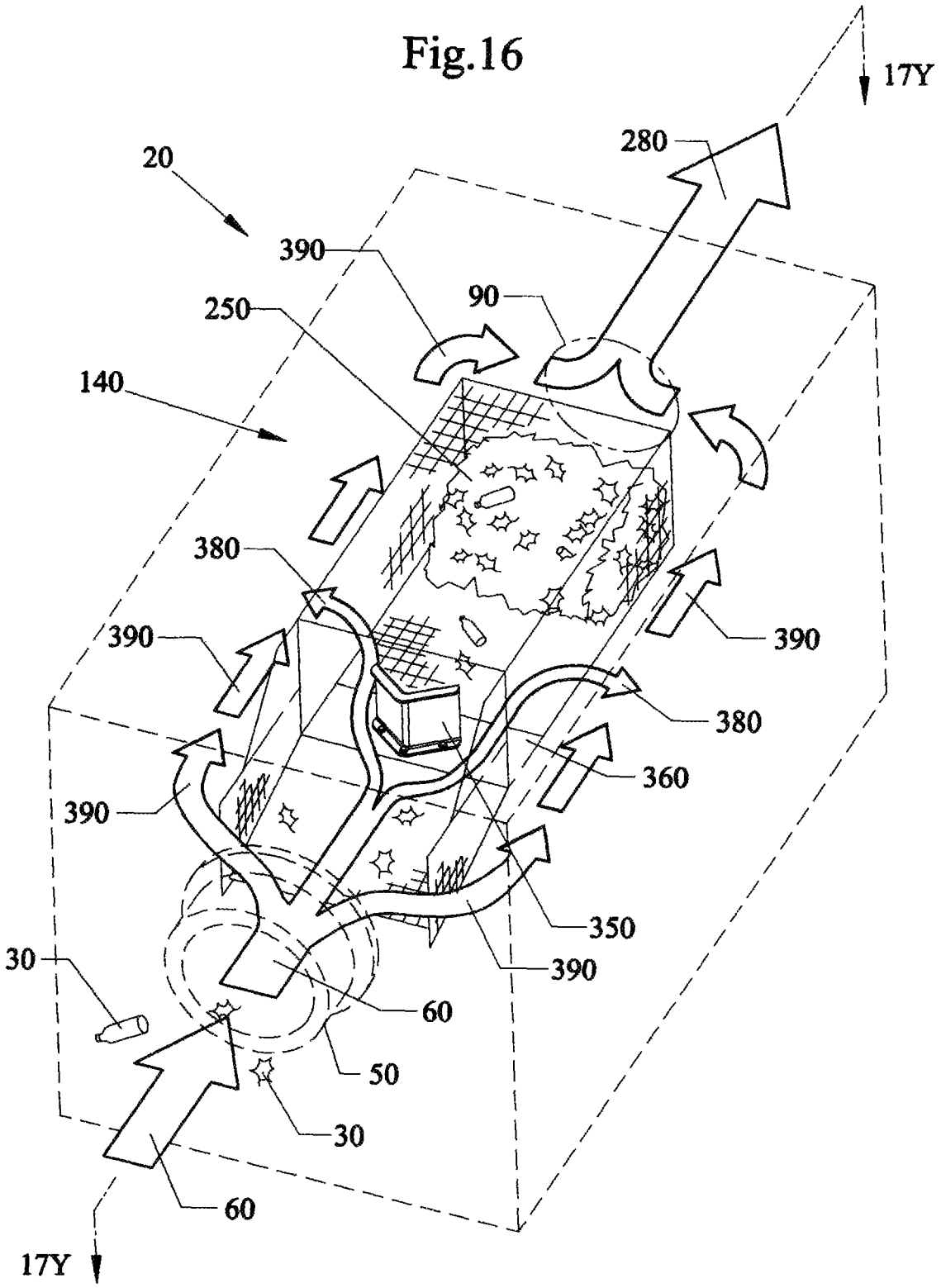
FIG. 16 is a top perspective view of the baffle box with half pylon installed and the screen system obstructed by previously collected floatables.
Figure 17:
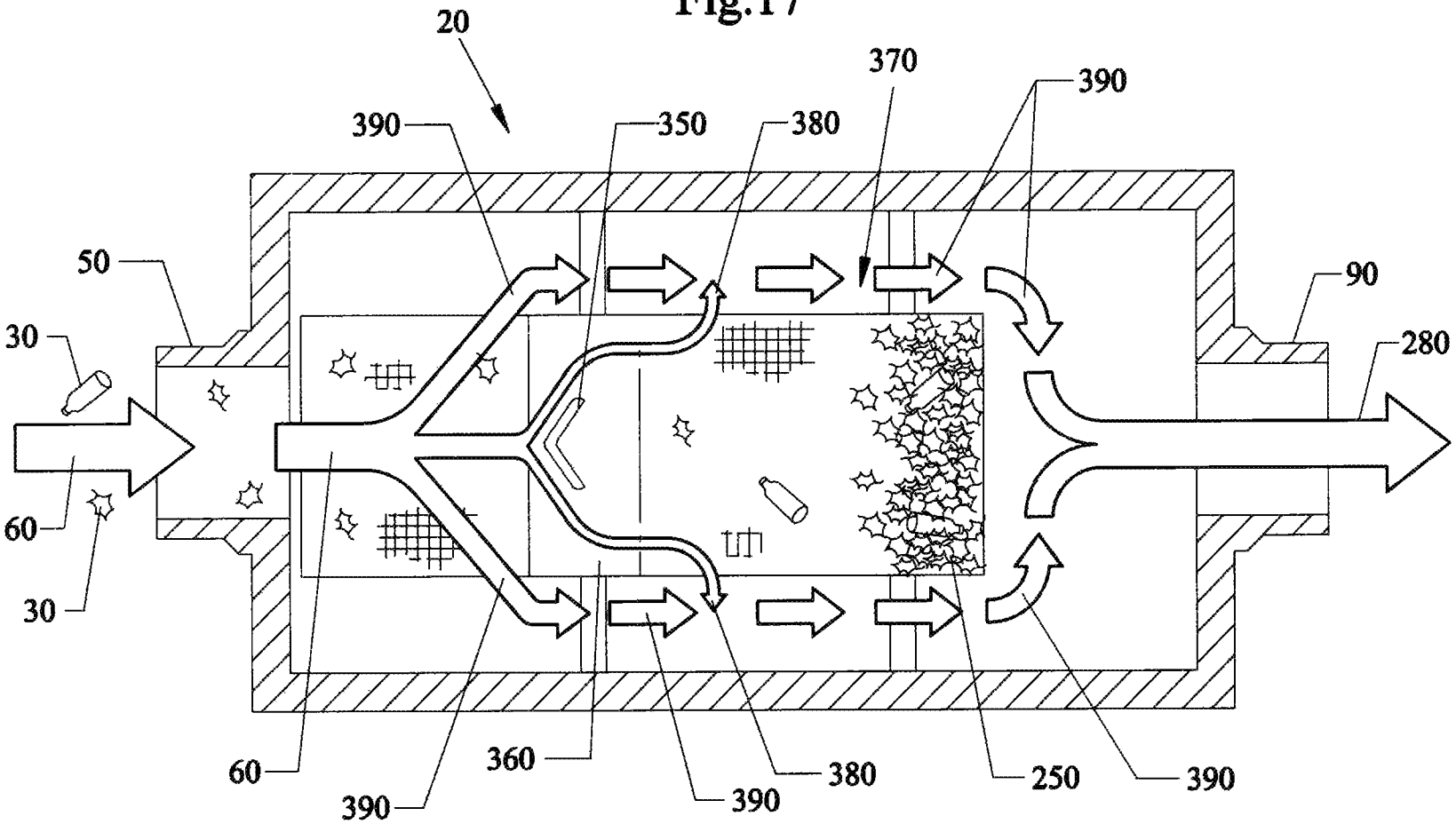
FIG. 17 is a top cross-sectional view of the baffle box with installed half pylon of FIG. 16 along arrow 17Y.

FIG. 16 is a top perspective view of the baffle box 20 with half pylon 350 installed and the screen system 140 obstructed by previously collected floatables. FIG. 17 is a top cross-sectional view of the baffle box 20 with installed half pylon 350 of FIG. 16 along arrow 17Y.

The pylon 350 can be rigid, smooth, and shaped to spread the water flow entering the screen system. The height of the pylon 350 can vary depending of site specific criteria and the width of the pylon 350 can be approximately ⅓ the width of the screen system 2. Floating debris that impacts the pylon 350 is able to easily slip off the pylon 350 and continue into the screen system 140/370. The pylon 350 can have a wedge or triangular front face configuration that faces the incoming water flow. The triangle can range from approximately 30 degrees to over approximately 70 degrees. The sharper the tip and angle of the triangle, the greater the chance of breaking up debris, which will eliminate clogging effects in the system.

The front face of the pylon can also be flat so as not to cause shedding or breaking up of debris. Also the front face of the pylon can be convex rounded, and the like.

Generally, the flow entering a storm water vault is conveyed via a round pipe 50 and the water will enter centrally into the screen system 140/370 with significant velocity. This makes for a concentrated central flow in the screen system. The pylon 350 acts to spread the flow wide within the screen system 140/370 so that the flow entering the screen system is traveling at the same velocity across the width of the screen system. Because the flow is no longer concentrated in the screen system 2 a backflow is prevented from forming. Without a backflow previously captured debris will not be able to escape the screen system 140/370, and additional debris will continue to be collected in the screen system.

Referring to FIGS. 14-15, the presence of the pylon 350 discourages back flow of previously collected floatables out of the obstructed screen system. Inflowing storm water 60 is turned away by the pylon 350 and back pressure 390 in the screen system and flows around 390 the screen system 140/370. Diminished flow 380 around the pylon 350 and into the screen system 140 flows out 380 of the sides of the screen system.

Optionally, working in conjunction with the pylon 350 can be an inflow gap 16 or opening in the bottom of the screen system adjacent to the inflow, similar to that shown in the previous embodiment. As water flows into the storm water vault both sediments and floating debris can drop through the gap 16 into a sediment settling collection chamber in the bottom of the vault. The inflow gap 16 can be directly under the inflow and before the bottom of the screen system 140/370 begins. Because sediments are heavier than water they are concentrated along the bottom of the inflowing water and within close proximity to the inflow gap. A relatively high percentage of the sediments can fall through the inflow gap 16 and into the lower sediment collection chamber(s). This changes the ratio of sediment to floatables in the screen system so that less sediment is involved with the collected floating debris. This enables the floating debris to pass water flow more readily, and in doing so reduces the likelihood that a backflow current condition problem will develop in the screen system.

Once a storm water condition such as one caused by a rain event is over the collected floating debris will dry out and to fall off of the vertical walls of the screen system. If the screen system has a screened lid the dried floating debris will fall off of the lid. As the floating debris falls off the screens the openings in the screens become available to handle the water flow from the next storm water rain type event.

Full Pylon Embodiment

Figure 18:
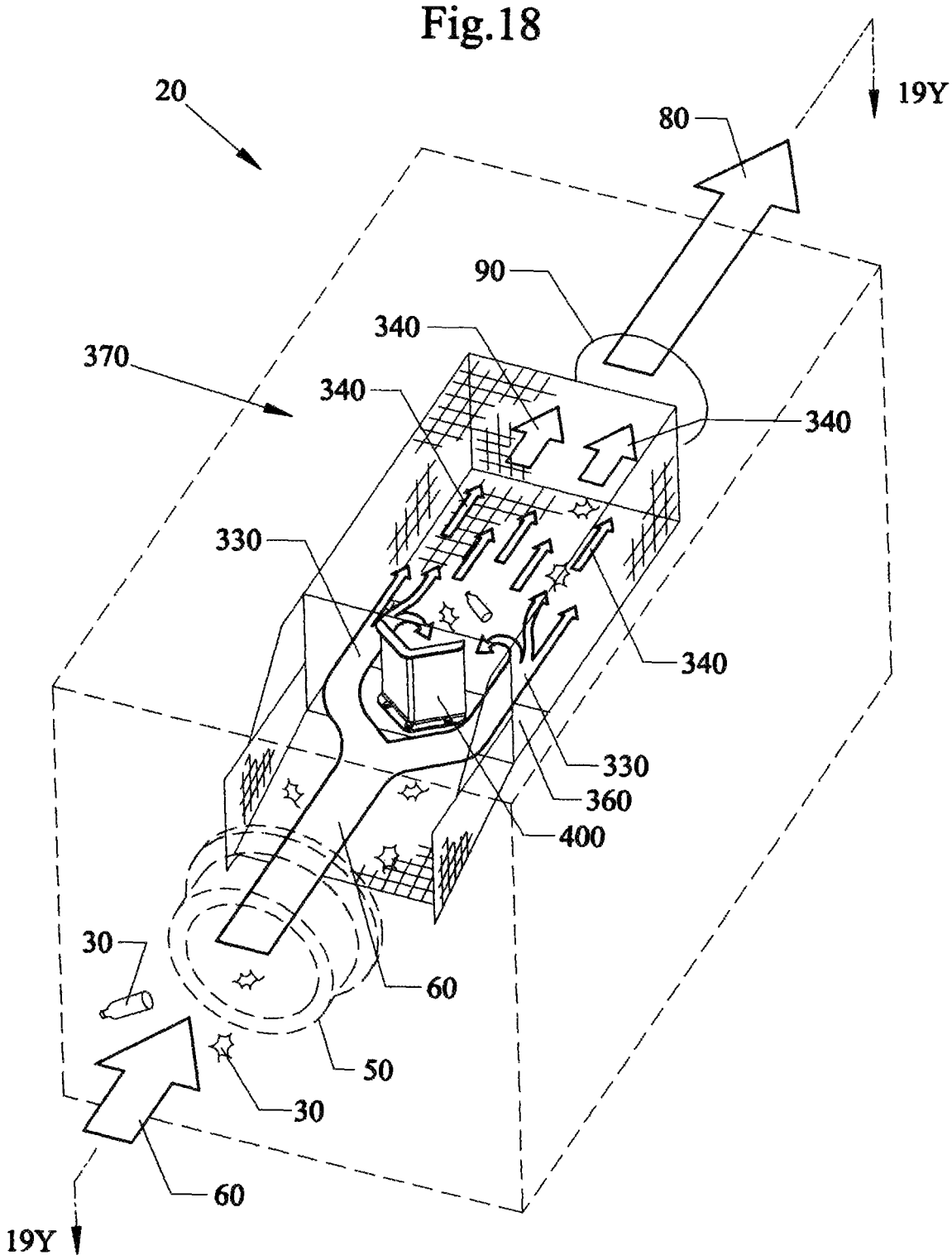
FIG. 18 is a top perspective view of a baffle box with full pylon installed at the head of the screen system.
Figure 19:
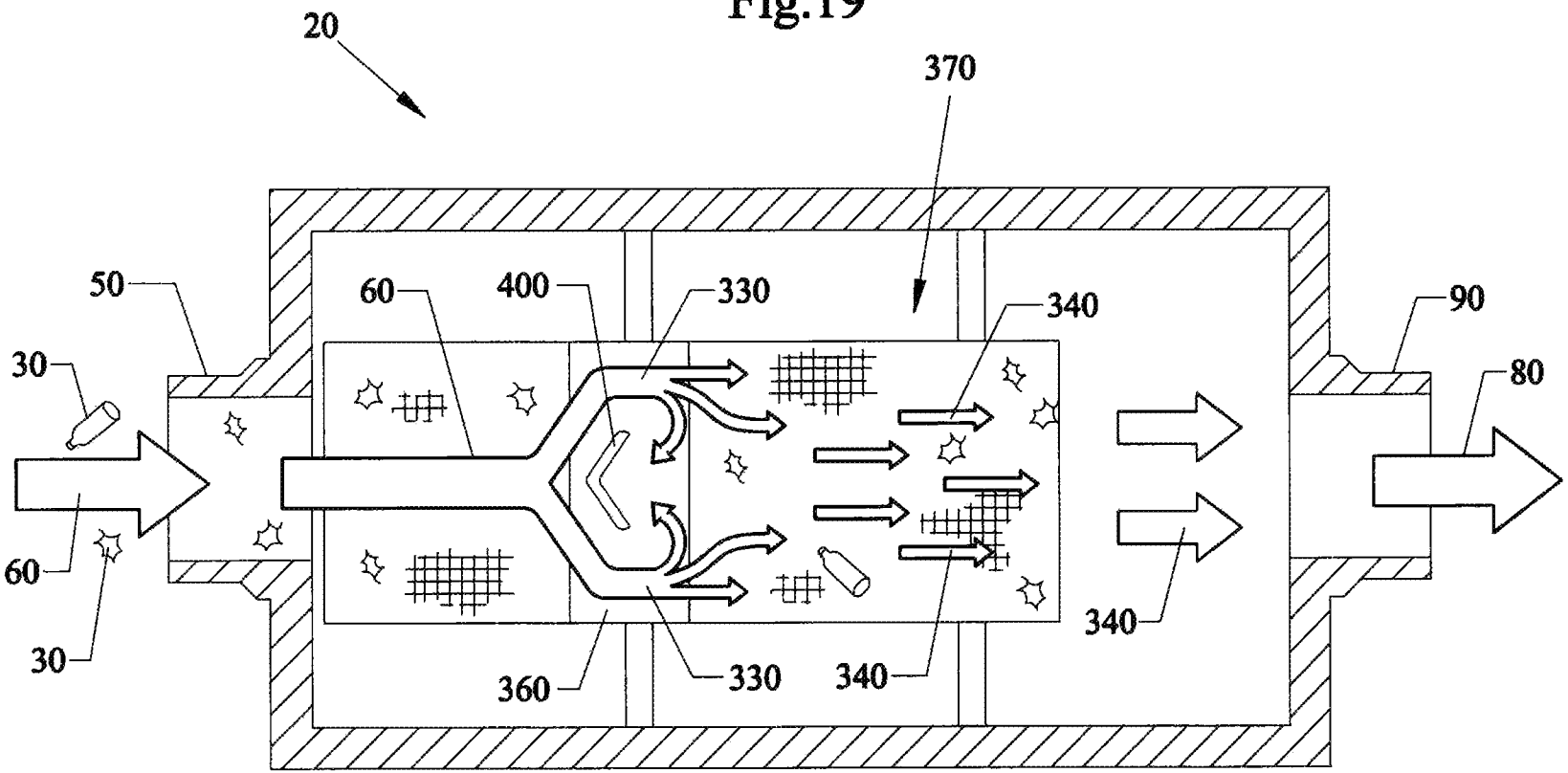
FIG. 19 is a top cross-sectional view of baffle box installed with a fully pylon of FIG. 18 along arrow 19Y.

FIG. 18 is a top perspective view of a baffle box 20 with full height pylon 400 installed at the head of the screen system 370. FIG. 19 is a top cross-sectional view of baffle box 20 installed with the full pylon of FIG. 18 along arrow 19Y.

Referring to FIGS. 18-19, the full size pylon 400 can also be mounted on a plate 260, such as a metal plate that replaces part of the floor of the screen system. The full size pylon can have a height rising from the floor of the screen system up to the ceiling of the screen system. The presence of the full height pylon 400 discourages back flow out of the screen system which would release previously collected floatables. Water flows freely around 330 the pylon 400 and through screen system 370.

Figure 20:
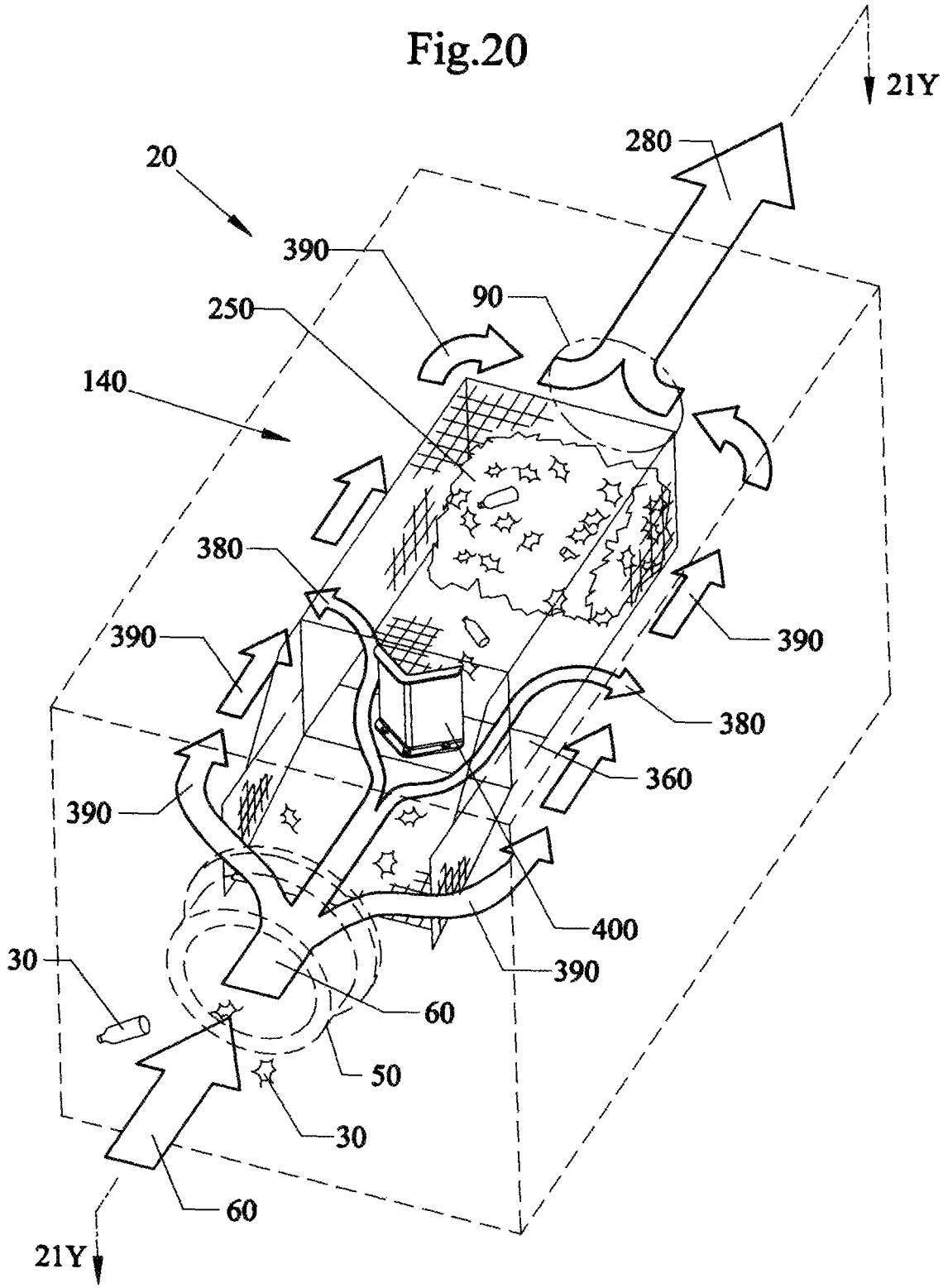
FIG. 20 is a top perspective view of the baffle box with installed full pylon of FIG. 18 with screen system being obstructed by previously collected floatables.
Figure 21:
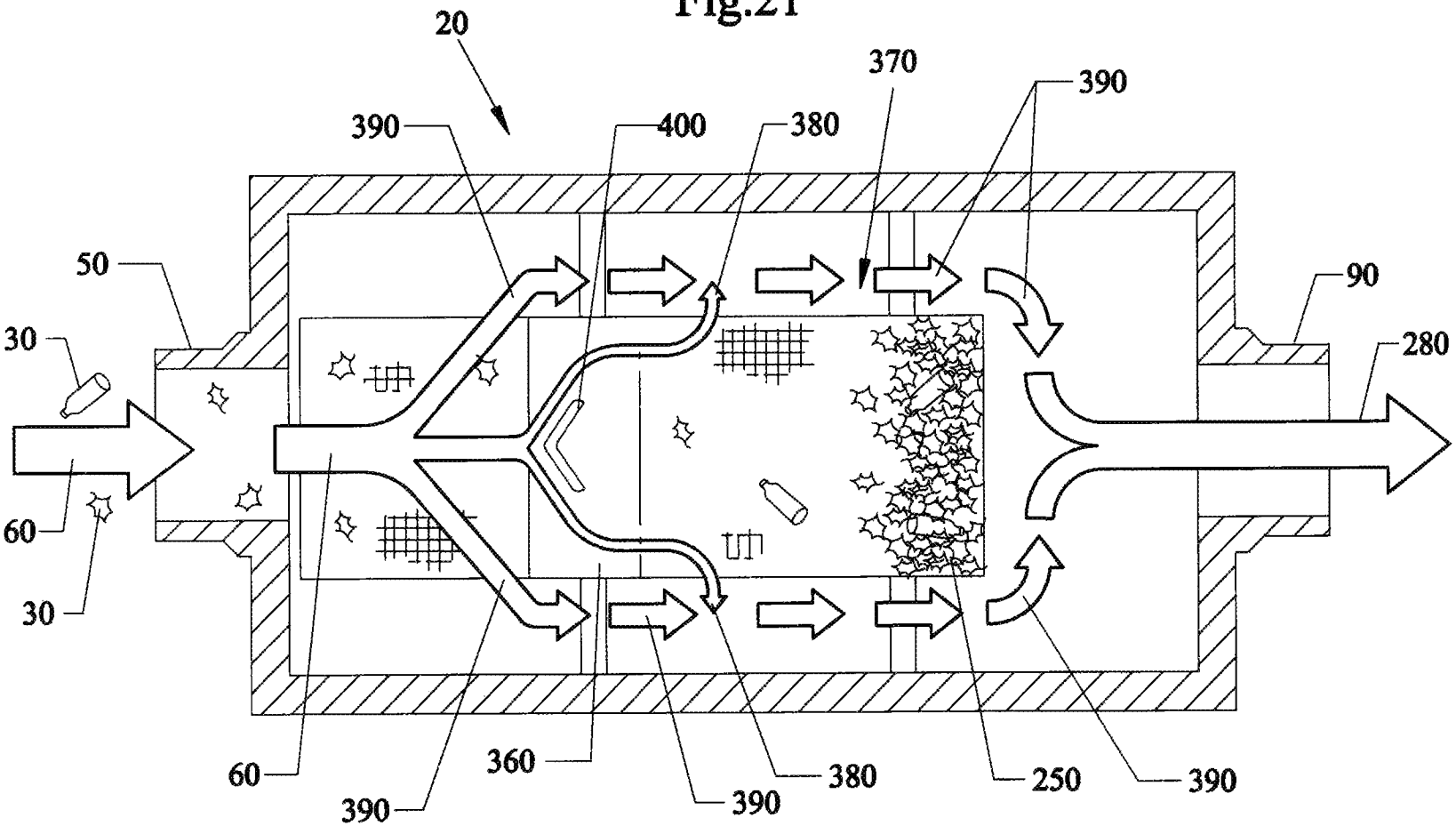
FIG. 21 is a top cross-sectional view of the baffle box with installed full pylon of FIG. 20 along arrow 21Y.

FIG. 20 is a top perspective view of the baffle box 20 with installed full pylon 400 of FIG. 18 with screen system 370 being obstructed by previously collected floatables. FIG. 21 is a top cross-sectional view of the baffle box 20 with installed full pylon 400 of FIG. 20 along arrow 21Y.

Referring to FIGS. 20-21, the presence of the full pylon discourages back flow of previously collected floatables out of the obstructed screen system. Inflowing storm water is turned away by the pylon 400 and back pressure 390 in the screen system and flows around the screen system. Diminished flow 380 around the pylon and into the screen system flows out of the sides of the screen system. The pylon can have some desirability over the pivoting panels since there are no moving parts, which can decrease maintenance labor and material costs.

Pivoting Panel and Pylon Combination Embodiment

Figure 22:
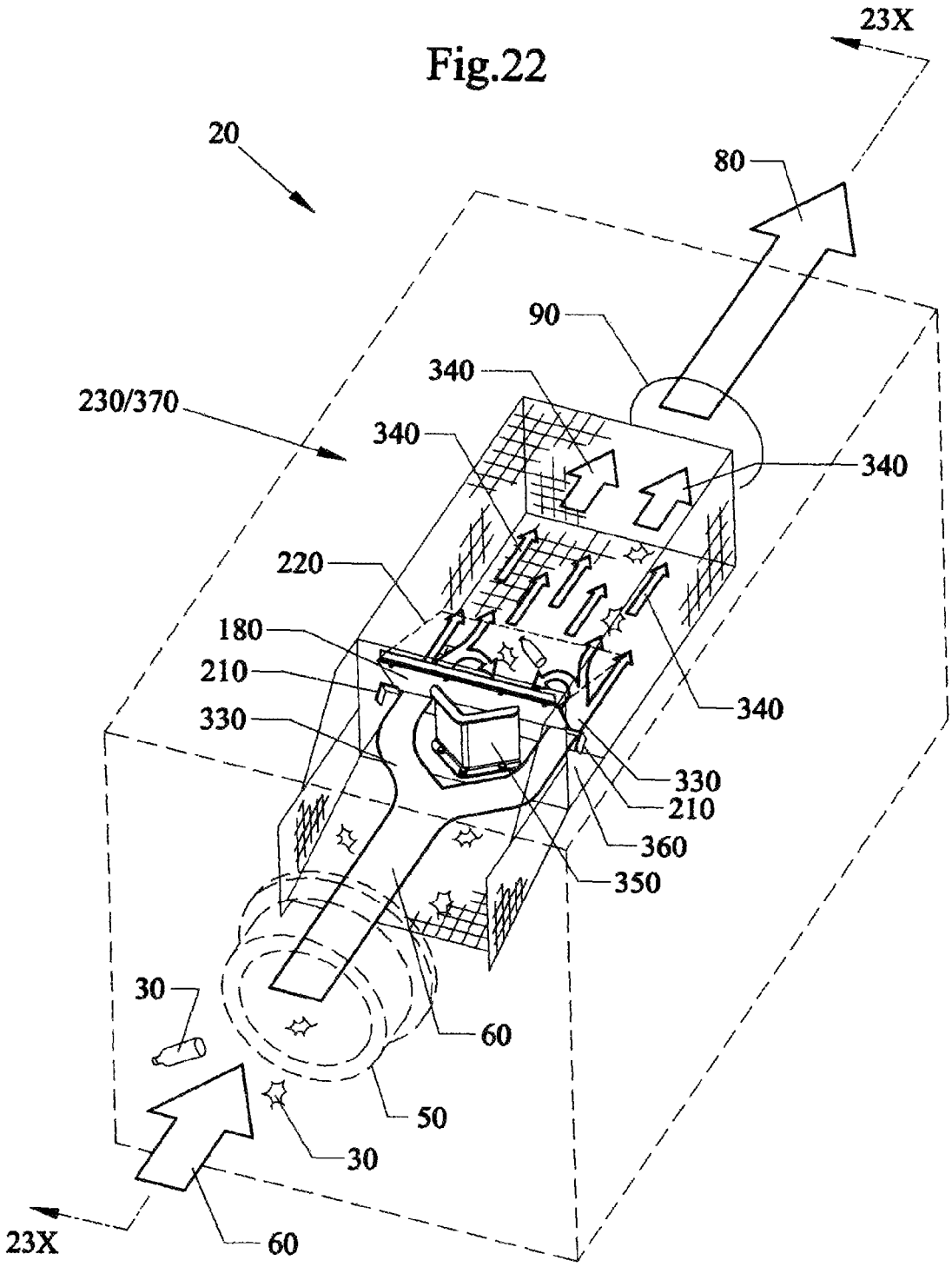
FIG. 22 is a top perspective of baffle box with half pylon and half pivot panel installed. A low flow condition is shown and the pivot panel rests atop the pylon.
Figure 23:
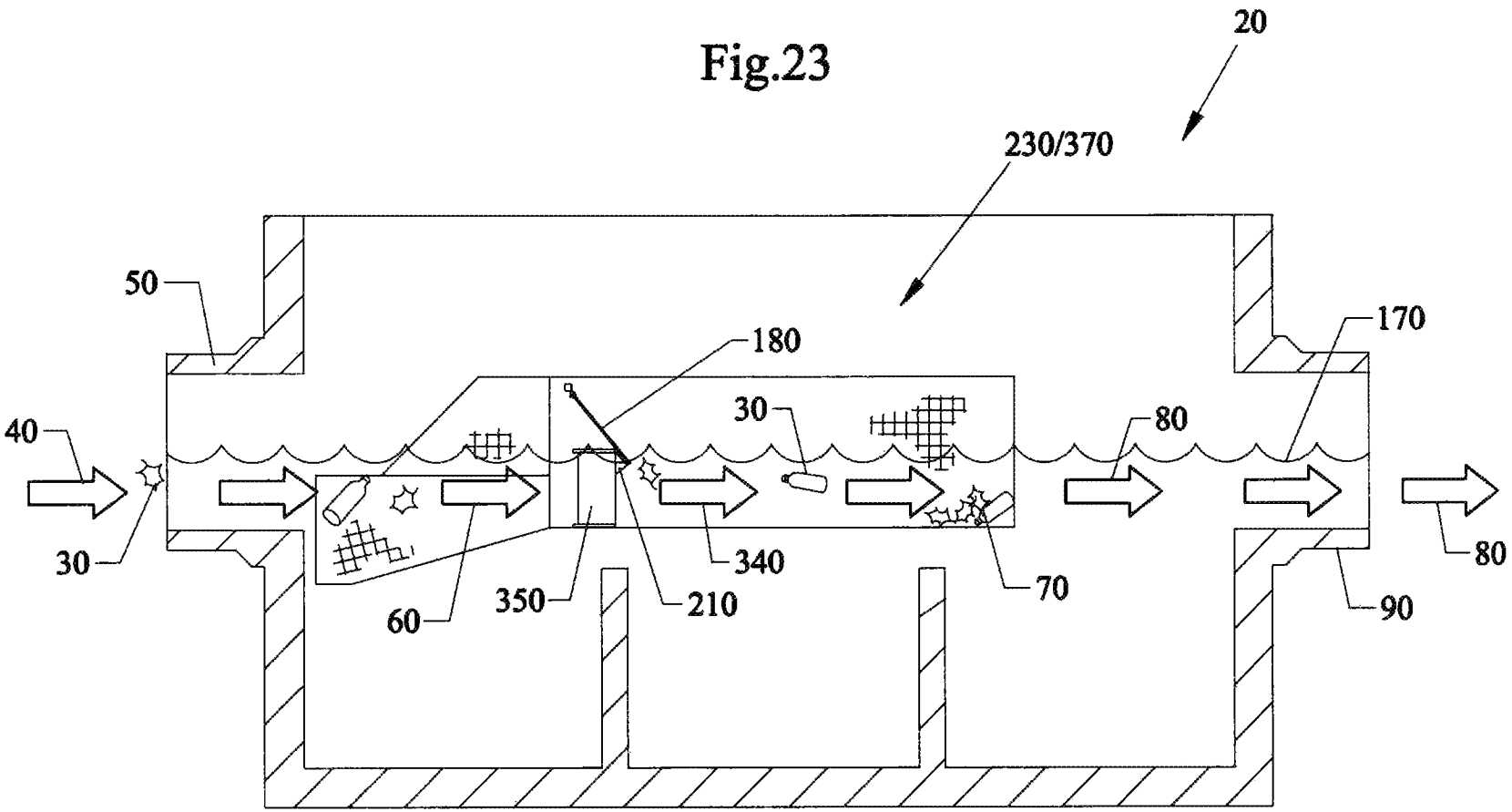
FIG. 23 is a cross-sectional side view of the baffle box with installed pylon and pivot panel of FIG. 22 along arrow 23X.

FIG. 22 is a top perspective of baffle box 20 with half pylon 350 and half pivot panel 180 installed in the screen system 230/370. FIG. 23 is a cross-sectional side view of the baffle box with installed pylon and pivot panel of FIG. 22 along arrow 23X.

Referring to FIGS. 22-23, the pylon 350 will not be tall and the pivoting panel 180 will not reach all the way to the bottom of the screen system. The pylon 350 will act to spread the flows wide and the pivoting panel 180 will act as a barrier to prevent floating debris from escaping if a backflow current tries to form. Because the pivoting panel 180 does not extend to the bottom of the screen system it cannot be encumbered by captured debris. In addition, if the flow is small then floating debris can enter the screen system without having to push past the pivoting panel. By combining the best attributes of the pivoting panel 180 and the pylon 350 a backflow current condition in the screen system can be avoided enabling floating debris to be continuously collected without the loss of previously captured debris.

Referring to FIGS. 22-23, the half pylon 350- and half pivot panel 180 can be installed similar to those in the previous embodiment. A low flow condition is shown by waterline 170 and the pivot panel 180 rests atop the pylon 350. Water flows freely around 330 pylon 350 and under the pivot panel 180 and through the screen system 230/370.

Figure 24:
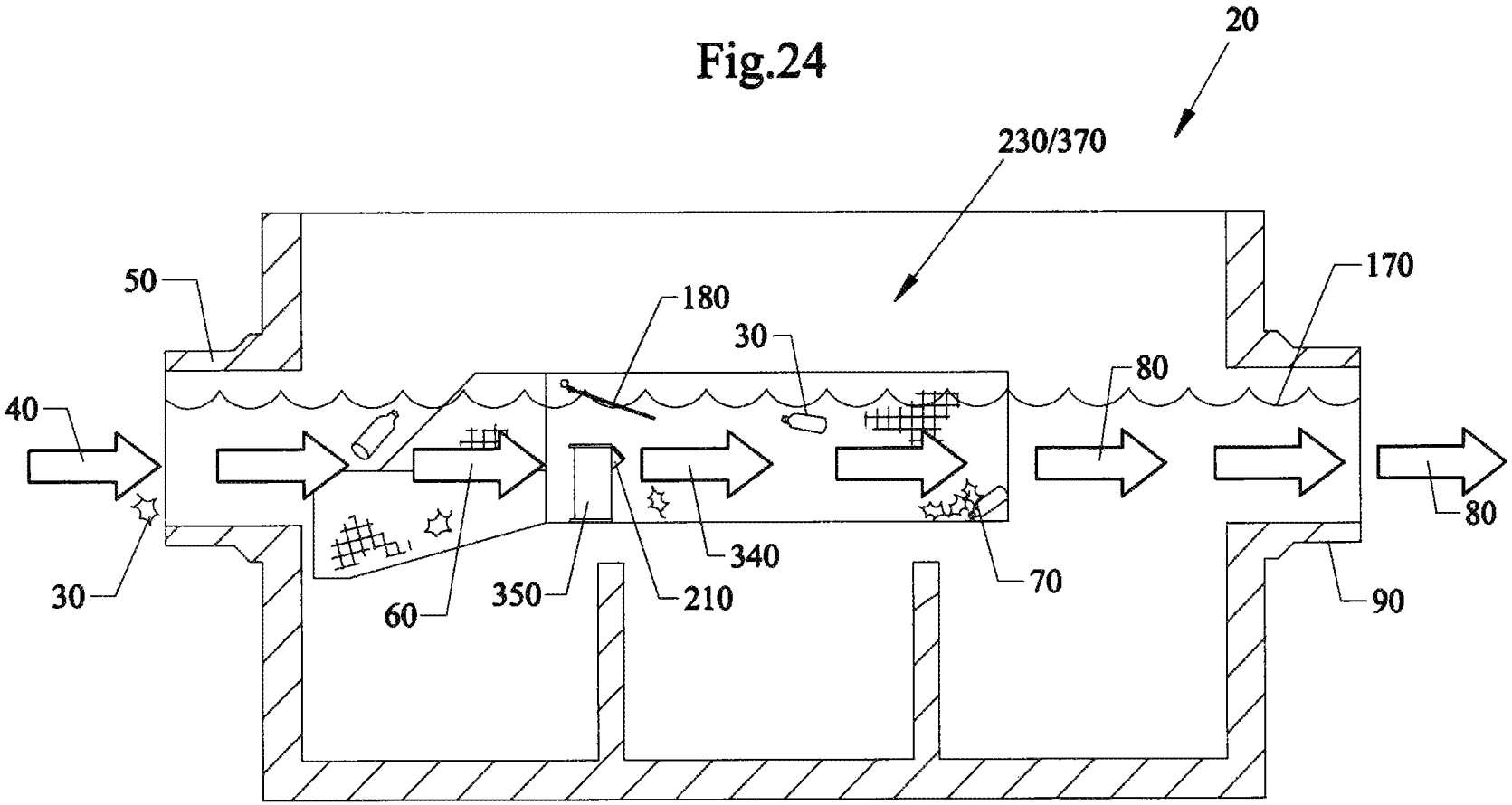
FIG. 24 is another cross-sectional side view of FIG. 22 along arrow 23X shown in a high flow condition. Increased water flow has raised the pivot panel.
Figure 25:
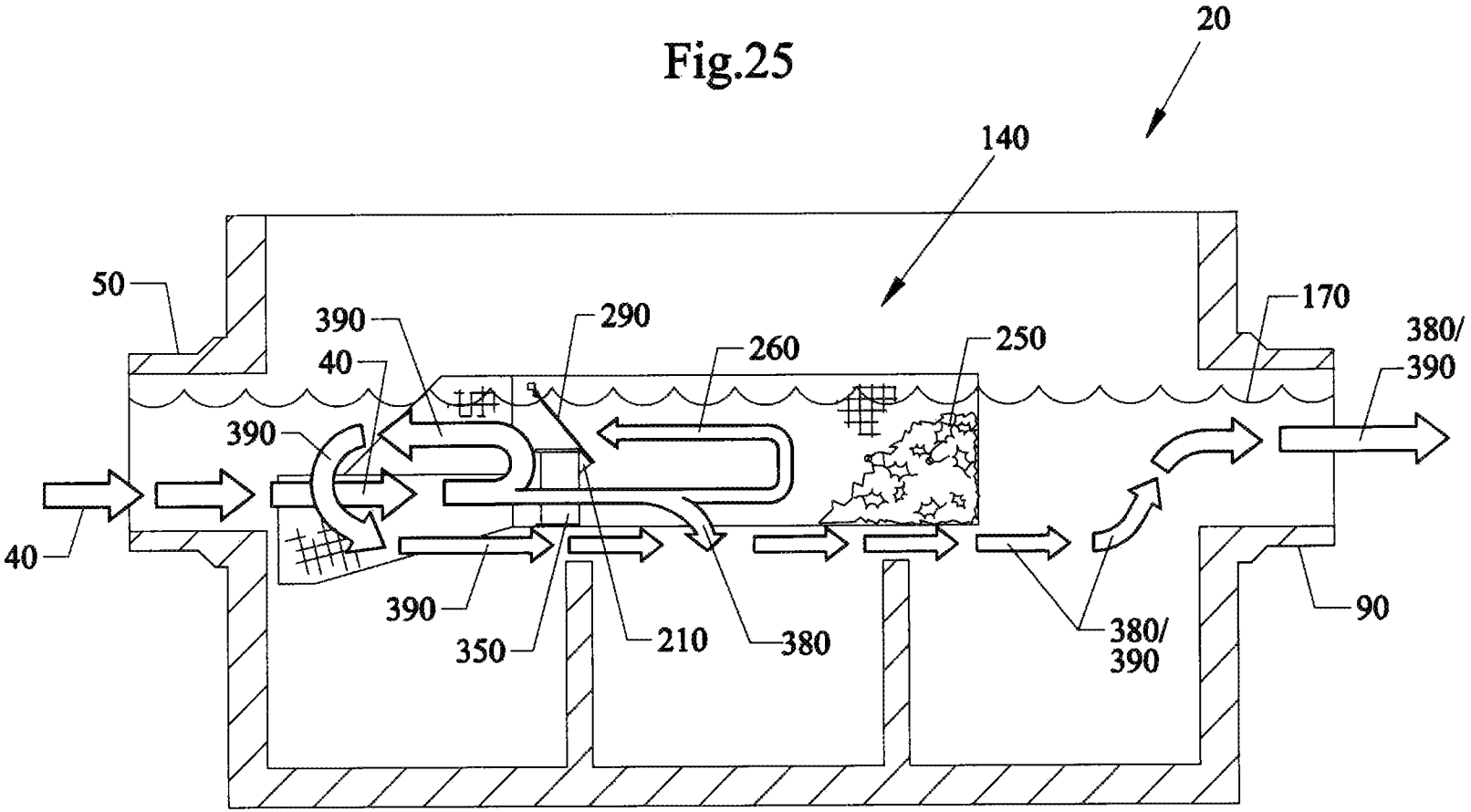
FIG. 25 another cross-sectional side sectional view of FIG. 22 along arrow 23X with the screen system obstructed by previously collected floatables.

FIG. 24 is another cross-sectional side view of FIG. 22 along arrow 23X shown in a high flow condition. Increased water flow has raised the pivot panel. FIG. 25 another cross-sectional side sectional view of FIG. 22 along arrow 23× with the screen system 230/370 obstructed by previously collected floatables. Water flows freely around 330 the pylon 350 and under the raised pivot panel 180 and through the screen system.

Back pressure 390 exerted by the obstruction locks the pivot panel 180 down 290. The presence of the pylon 350 and pivot panel 180 discourages back flow of previously collected floatables out of the obstructed screen system. Inflowing storm, water is turned away by the pylon 350/pivot panel 180 and flows around 380/390 the screen system. Diminished flow 380 around the pylon 350 and under the pivot panel 180 flows into the screen system out 380 of the sides of the screen system 230/370.

Optionally, the effectiveness of the combined pivoting panel 180 and pylon 350 can by enhanced by using an inflow gap 16 or opening at the lead in to the screen system as described in the previous embodiments. As water flows into the storm water vault both sediments and floating debris drop through the gap 16 into a settling chamber in the bottom of the vault. The inflow gap 16 can be directly under the inflow and before the bottom of the screen system 230/370 begins. Because sediments are heavier than water they are concentrated along the bottom of the inflowing water and within close proximity to the inflow gap 16. A relatively high percentage of the sediments will fall through the inflow gap 16 and into the lower sediment collection chamber(s). This changes the ratio of sediment to floatables in the screen system 2 so that less sediment is involved with the collected floating debris. And this enables the floating debris to pass water flow more readily, and in doing so reduces the likelihood that a backflow current condition will develop.

The gap can also act as a drain when the screen system is fully impacted (totally blocked off and will allow for floatables to be stored in a dry state between rainfalls.

Alternatively, the pylon can be attached to the roof of the screen system

Other embodiments can be used such as attaching a pivoting panel to the top of a pylon, so that the panel does not have to be attached to the screen system.

Once the storm water causing condition such as the rain event is over the collected floating debris will dry out and to fall off of the vertical walls of the screen system. If the screen system 2 has a screened lid the dried floating debris will fall off of the lid. As the floating debris falls off the screens the openings in the screens become available to handle the water flow from the next storm water type rain event.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An improved screen system for preventing backflow currents during storm water treatments, comprising:

a screen housing for being placed in a storm water treatment environment, the housing having an inlet end and an outlet end, with a left screen wall, a right screen wall, a screen top wall and screen bottom wall; and a backflow current preventer panel pivotally attached to the screen housing at the inlet end of the screen housing for diverting the incoming storm water downward through the screen system, wherein the panel pivots inside of the screen housing, and wherein the backflow current preventer stops debris from passing out of the screen system when incoming storm water is flowing through the screen system.

2. The improved screen system of claim 1, wherein the pivoting panel is sloped at an angle to the incoming storm water flowing through the screen system.

3. The improved screen system of claim 1, wherein the pivoting panel is substantially vertically oriented substantially perpendicular to the incoming storm water flowing through the screen system.

4. The improved screen system of claim 1, further comprising:

a hinge that attaches a top portion of the panel to the screen housing.

5. The improved screen system of claim 1, further comprising:

a gap in front of the screen housing for allowing sediment from incoming storm water to drop beneath the screen system.

6. The improved screen system of claim 1, wherein the pivoting panel includes:

a half panel that is pivotally attached to a ceiling of the screen housing and having a bottom end substantially between approximately ¾ to approximately ¼ the distance between the ceiling and a floor of the screen housing.

7. The improved screen system of claim 1, wherein the pivoting panel includes:

a full size panel that is pivotally attached to a ceiling of the screen housing and having a bottom end substantially adjacent to a floor of the screen housing.

8. An improved screen system for preventing backflow currents during storm water treatments, comprising:

a screen housing for being placed in a storm water treatment environment, the housing having an inlet end and an outlet end, with a left screen wall, a right screen wall, a screen top wall and screen bottom wall; and a backflow current preventer attached to the screen housing at the inlet end of the screen housing, the backflow current preventor includes:

a fixed pylon at the inlet end of the screen housing for diverting the incoming storm water to horizontally split to left and right sides inside of the screen housing.

9. The improved screen system of claim 8, wherein the pylon includes:

a flat face on a side facing the incoming storm water.

10. The improved screen system of claim 8, wherein the pylon includes:

a rounded face on a side facing the incoming storm water.

11. The improved screen system of claim 8, wherein the pylon includes:

a triangular shaped face on a side facing the incoming water.

12. The improved screen system of claim 8, further comprising:

a gap or opening in front of the screen system for allowing sediment from incoming storm water to drop beneath the screen system.

13. The improved screen system of claim 8, wherein the pylon includes:

a half size pylon having a bottom end adjacent to a floor of the screen housing.

14. The improved screen system of claim 8, wherein the pylon includes:

a full size pylon that runs between a floor and ceiling of the screen housing.

15. An improved screen system for preventing backflow currents during storm water treatments, comprising:

a screen housing for being placed in a storm water treatment environment, the housing having an inlet end and an outlet end, with a left screen wall, a right screen wall, a screen top wall and screen bottom wall; and a backflow current preventer attached to the screen housing at the inlet end of the screen housing, the backflow current preventor includes both:

a pivoting panel pivotally attached to the screen housing at the inlet end of the screen housing for diverting the incoming storm water downward through the screen housing and prevents floatables from escaping the screen housing; and a fixed pylon at the inlet end of the screen housing for diverting the incoming storm water to horizontally split to left and right sides inside of the screen housing.

16. The improved screen system of claim 15, further comprising:

a gap or opening adjacent to the inlet of the screen housing for allowing sediment from incoming storm water to drop beneath the screen housing.

17. A storm water screen system with pivotable gate for preventing backflow currents during storm water treatments, comprising:

a screen housing for being placed in a storm water treatment environment, the housing having an inlet end and an outlet end, with a left screen wall, a right screen wall, a screen top wall and screen bottom wall; and a pivoting panel attached to the screen housing at the inlet end of the screen housing for downwardly diverting the incoming storm water downward through the screen housing to prevent backflow current which stops debris from passing out of the screen housing when incoming storm water is flowing through the screen housing wherein the panel pivots into the screen housing.

18. The storm water screen system of claim 17, further comprising:

a hinge that attaches a top portion of the panel to the screen housing.

19. The storm water screen system of claim 17, further comprising:

a gap or opening adjacent to the inlet to the screen housing for allowing sediment from incoming storm water to drop beneath the screen housing to prevent the screen housing system from holding water.

20. A storm water screen system with pylon diverter for preventing backflow currents during storm water treatments, comprising:

a screen housing for being placed in a storm water treatment environment, the housing having an inlet end and an outlet end, with a left screen wall, a right screen wall, a screen top wall and screen bottom wall; and a fixed pylon at the inlet end of the screen housing for splitting the incoming storm water through the screen housing to prevent backflow current which stops debris from passing out of the screen housing when the incoming storm water is flowing through the screen system.

21. The storm water screen system of claim 20, wherein the pylon diverter includes:

a flat face on a side facing the incoming storm water.

22. The storm water screen system of claim 20, wherein the pylon diverter includes:

a nonflat flat face on a side facing the incoming storm water.

23. The improved screen system of claim 20, further comprising:

a gap in front of the screen housing for allowing sediment from incoming storm water to drop beneath the screen housing.

24. A method for preventing backflow currents in storm water treatment systems, comprising the steps of:

positioning a screen housing in a storm water treatment environment, the housing having an inlet end and an outlet end, with a left screen wall, a right screen wall, a screen top wall and screen bottom wall;

flowing incoming storm water with debris into the inlet input end of the screen housing;

preventing backflow current from occurring inside of the screen housing by at least one of: downwardly diverting the incoming storm water entering into the inlet end of the screen housing, and splitting the incoming storm water entering into the inlet end of the screen housing; and stopping debris from passing out of the outlet end of the screen housing when the incoming storm water is flowing through the screen system.

25. The method of claim 24, wherein the downwardly diverting step includes the step of:

providing a pivotable panel for downwardly diverting the incoming storm water entering into the inlet end of the screen housing.

26. The method of claim 24, further comprising the step of:

collecting sediment from the incoming storm water through a gap in front of the inlet end of the screen housing.

27. The method of claim 24, wherein the splitting step includes the step of:

providing a pylon for splitting the incoming storm water entering into the inlet end of the screen housing.

28. The method of claim 24, wherein the preventing step further includes the steps of:

providing a pivotable panel for downwardly diverting the incoming storm water entering into the inlet end of the screen housing; and providing a pylon for splitting the incoming storm water entering into the inlet end of the screen housing.

* * * * *